US008357885B2

(12) United States Patent
Rundquist et al.

(10) Patent No.: US 8,357,885 B2
(45) Date of Patent: Jan. 22, 2013

(54) MICROWAVE FURNACE

(75) Inventors: Victor F. Rundquist, Carrollton, GA (US); William J. Gregory, Carrollton, GA (US); Kevin S. Gill, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 777 days.

(21) Appl. No.: 12/541,190

(22) Filed: Aug. 14, 2009

(65) Prior Publication Data

US 2010/0032429 A1 Feb. 11, 2010

Related U.S. Application Data

(63) Continuation-in-part of application No. 12/199,951, filed on Aug. 28, 2008, and a continuation-in-part of application No. 12/109,421, filed on Apr. 25, 2008.

(60) Provisional application No. 60/926,299, filed on Apr. 26, 2007, provisional application No. 61/032,177, filed on Feb. 28, 2008.

(51) Int. Cl.
*H05B 6/70* (2006.01)

(52) U.S. Cl. ..... 219/690; 219/698; 219/704

(58) Field of Classification Search ..... None
See application file for complete search history.

(56) References Cited

U.S. PATENT DOCUMENTS

| | | | | |
|---|---|---|---|---|
| 3,687,170 | A | 8/1972 | Malone et al. | |
| 3,732,048 | A | 5/1973 | Guerga et al. | 425/174.4 |
| 3,951,904 | A | 4/1976 | Tomonaga | |
| 4,330,698 | A | 5/1982 | Sawada et al. | 219/10.55 |
| 4,930,755 | A | 6/1990 | Ekerot et al. | 266/44 |
| 5,134,261 | A | 7/1992 | Larkin et al. | |
| 5,166,488 | A | 11/1992 | Peppard | 219/10.55 R |
| 5,168,917 | A | 12/1992 | Okuda et al. | 164/495 |
| 5,358,223 | A | 10/1994 | Bleijendaal et al. | |
| 5,449,887 | A | 9/1995 | Holcombe et al. | |
| 6,782,669 | B1 | 8/2004 | Dixon | |
| 6,853,395 | B1 * | 2/2005 | Becher | 347/225 |
| 7,011,136 | B2 | 3/2006 | Moore et al. | 164/250.1 |
| 7,161,126 | B2 * | 1/2007 | Ripley | 219/775 |
| 2002/0027135 | A1 * | 3/2002 | Fagrell et al. | 219/690 |
| 2003/0089481 | A1 | 5/2003 | Moore et al. | |
| 2003/0111462 | A1 | 6/2003 | Sato et al. | |

(Continued)

FOREIGN PATENT DOCUMENTS

| | | | |
|---|---|---|---|
| EP | 0 160 488 | A2 | 11/1985 |
| JP | 10-107507 | A | 4/1998 |

(Continued)

OTHER PUBLICATIONS

U.S. Final Office Action dated Jan. 18, 2012 cited in U.S. Appl. No. 12/199,951, 13 pgs.

(Continued)

*Primary Examiner* — Alonzo Chambliss
(74) *Attorney, Agent, or Firm* — Merchant & Gould

(57) ABSTRACT

A system for melting a substance may be provided. The system may comprise at least one burner probe. The at least one burner probe may comprise an absorber and a first wave guide configured to transmit microwaves. The absorber may be configured to receive the microwaves from the first wave guide and to convert energy from the microwaves into heat. The system may further comprise a second wave guide and a rotating wave guide. The rotating wave guide may be positioned between the first wave guide and the second wave guide. The rotating wave guide may comprise a plurality of sections configured to rotate about a central axis. The rotating wave guide may be configured to rotate approximately 90 degrees. For example, the rotating wave guide may comprise three sections wherein each one of the three sections may be configured to rotate approximately 30 degrees.

20 Claims, 22 Drawing Sheets

U.S. PATENT DOCUMENTS

| | | | | |
|---|---|---|---|---|
| 2004/0056026 | A1 | 3/2004 | Jakes et al. | 219/701 |
| 2004/0107796 | A1 | 6/2004 | Kumar et al. | |
| 2004/0238794 | A1 | 12/2004 | Karandikar et al. | |
| 2005/0049138 | A1 | 3/2005 | McGowan | |
| 2005/0082282 | A1 | 4/2005 | Smrcek et al. | |
| 2006/0016805 | A1 | 1/2006 | Del Regno | |
| 2006/0096977 | A1* | 5/2006 | Ripley | 219/690 |
| 2008/0142511 | A1 | 6/2008 | Ripley | 219/690 |
| 2008/0272113 | A1 | 11/2008 | Rundquist et al. | |
| 2009/0084780 | A1 | 4/2009 | Rundquist et al. | |

FOREIGN PATENT DOCUMENTS

| | | |
|---|---|---|
| WO | WO 00/0311 | 1/2000 |
| WO | WO 03/042616 | 5/2003 |

OTHER PUBLICATIONS

European Communication dated Mar. 15, 2011 cited in Application No. 08 754 932.5.

U.S. Final Office Action dated Apr. 1, 2011 cited in U.S. Appl. No. 12/109,421.

European Communication dated Apr. 5, 2011 cited in Application No. 09791583.9.

Chinese First Office Action dated Feb. 13, 2012 cited in Application No. 200880020676.X, 15 pgs.

European Communication dated Jul. 27, 2011 cited in Application No. 09791583.9.

U.S. Office Action dated Aug. 11, 2011 cited in U.S. Appl. No. 12/199,951.

U.S. Office Action dated Oct. 7, 2010 cited in U.S. Appl. No. 12/109,421.

International Search Report dated Oct. 7, 2009 cited in International Application No. PCT/US2009/054042.

International Search Report dated Nov. 16, 2010 cited in Application No. PCT/US2010/045473.

T. Tsukagoshi, "Study on Microwave Energy Absorption in Wedge Type Electromagnetic Wave Absorber and Its Application to Microwave Heating", 1995, IEEE, pp. 568-572.

International Search Report dated Jul. 17, 2008 cited in International Application No. PCT/US2008/061590.

Chinese Second Office Action dated Nov. 14, 2012 cited in Application No. 200880020676.X, 8 pgs.

* cited by examiner

| | |
|---|---|
| Type | Power Loss Density (rms) |
| Monitor | loss (f=915) [1] |
| Maximum-3d | 76.9926 W/m^3 at -7.6 / -1.56522 / 30.1818 |
| Frequency | 915 |

Type Power Loss Density (rms)
Monitor loss (f=915) [1]
Maximum-3d 76.9926 W/m^3 at -7.6 / -1.56522 / 30.1818
Frequency 915

MICROWAVE FURNACE

RELATED APPLICATION

This application is a continuation-in-part (CIP) of U.S. application Ser. No. 12/199,951, filed Aug. 28, 2008, which is incorporated herein by reference. U.S. application Ser. No. 12/199,951 is a continuation-in-part (CIP) of U.S. application Ser. No. 12/109,421, filed Apr. 25, 2008, which is also incorporated herein by reference. Furthermore, under provisions of 35 U.S.C. §119(e), U.S. application Ser. No. 12/109,421 claimed the benefit of U.S. provisional application No. 60/926,299, filed Apr. 26, 2007, and U.S. provisional application No. 61/032,177, filed Feb. 28, 2008, both of which are incorporated herein by reference.

COPYRIGHTS

All rights, including copyrights, in the material included herein are vested in and the property of the Applicants. The Applicants retain and reserve all rights in the material included herein, and grant permission to reproduce the material only in connection with reproduction of the granted patent and for no other purpose.

BACKGROUND

Metal melting is performed in a furnace. Virgin material, external scrap, internal scrap, and alloying elements are used to charge the furnace. Virgin material refers to commercially pure forms of the primary metal used to form a particular alloy. Alloying elements are either pure forms of an alloying element, like electrolytic nickel, or alloys of limited composition, such as ferroalloys or master alloys. External scrap is material from other forming processes such as punching, forging, or machining. Internal scrap consists of the gates, risers, or defective castings.

Furnaces are refractory lined vessels that contain the material to be melted and provide the energy to melt it. Modern furnace types include electric arc furnaces (EAF), induction furnaces, cupolas, reverberatory, and crucible furnaces. Furnace choice is dependent on the alloy system and quantities produced. Furnace design is a complex process, and the design can be optimized based on multiple factors.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A system for melting a substance may be provided. The system may comprise at least one burner probe. The at least one burner probe may comprise an absorber and a first wave guide configured to transmit microwaves. The absorber may be configured to receive the microwaves from the first wave guide and to convert energy from the microwaves into heat. The system may further comprise a second wave guide and a rotating wave guide. The rotating wave guide may be positioned between the first wave guide and the second wave guide. The rotating wave guide may comprise a plurality of sections configured to rotate about a central axis.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
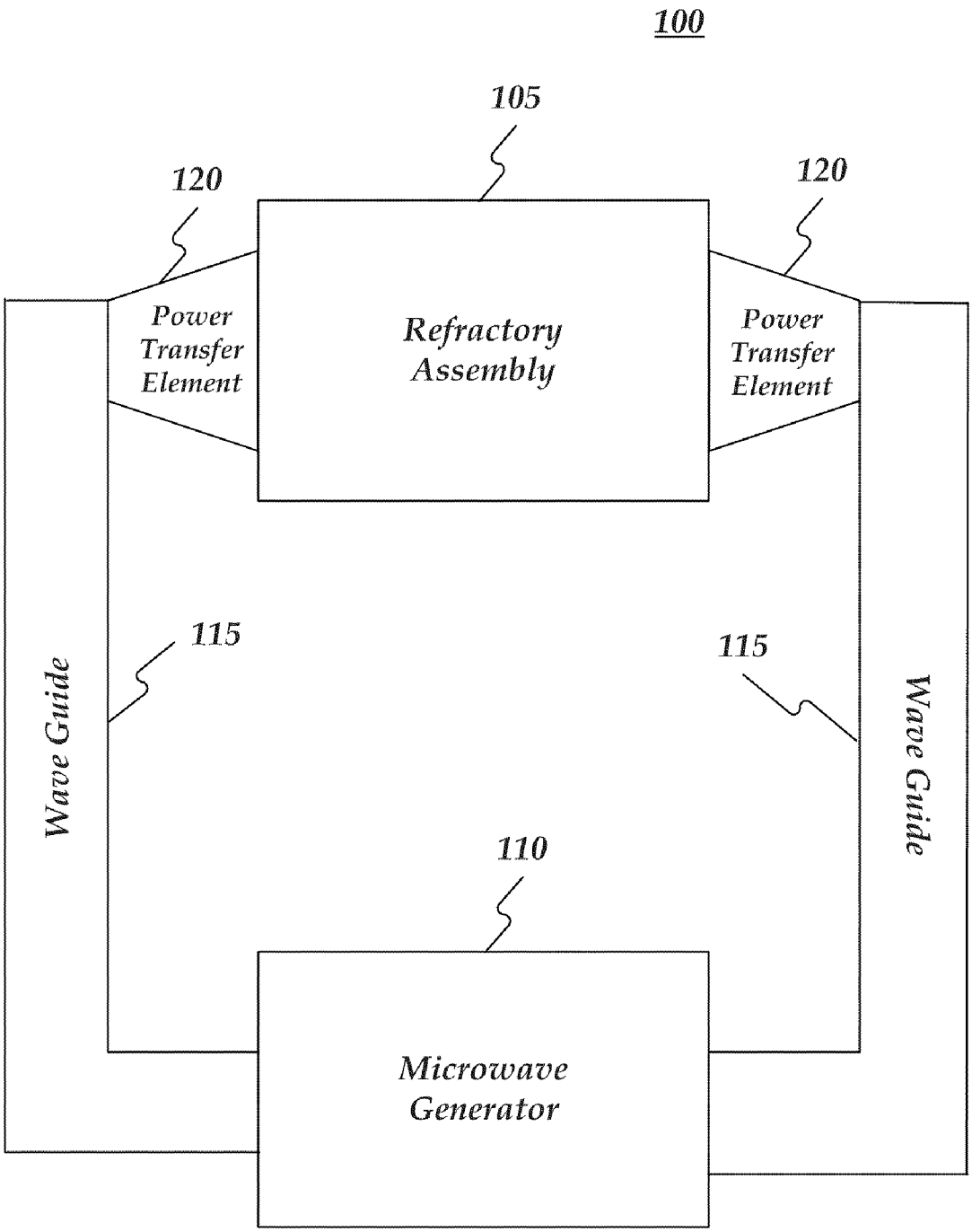
FIG. 1 shows a microwave furnace.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

A microwave furnace may be provided. Consistent with embodiments of the present invention, a microwave furnace may melt metals more efficiently and generate lower emissions than conventional furnaces. Consistent with embodiments of the invention, microwave energy may be used to generate heat inside a refractory wall. This heat may be transferred to a substance (e.g. metal) to be melted. The aforementioned substance may comprise any substance and is not limited to metal. The process may be continuous and may not leak hazardous amounts of microwave energy.

Furthermore, embodiments of the invention may crosslink polymers in-line. The process of crosslinking polymers may include heating the polymer to initiate the crosslinking reaction. Microwave energy may be applied to the polymer causing it to heat and the reaction to take place. This heat input to the polymer may occur quickly.

By using materials and certain geometries, the furnace's refractory walls may absorb a near maximum energy amount. A thermal insulation material may be used as a one-way energy device. This insulation material may allow microwave energy to flow freely while at the same time not allowing thermal energy to escape, for example, in a direction opposite to the microwave energy flow.

Embodiments of the invention may provide a method for melting using electrical energy. This process may avoid some or all issues associated with conventional melting. Moreover, processes consistent with embodiments of the invention may be cleaner, less dross or slag may be created during the melting process, and the molten substance's temperature may be easy to control. Furthermore, embodiments of the invention may avoid problems with conventional induction furnaces in that embodiments of the invention may not need to start with molten substance. Conventional induction furnaces must start with molten metal before more metal can be melted. In contrast, embodiments of the invention may start to heat with solid substance or even no substance.

Furthermore, embodiments of the invention may be modular. While, embodiments of the invention may include a module in a larger furnace, to increase the size, these modules may be stacked, for example, on top of one another and also end-to-end. The design of refractory may be modified to allow for the substance to flow from module to module. In addition, embodiments of the invention may allow for 'zone' heating. For example, by keeping lower modules hotter than upper modules, stirring may be induced in the molten substance through convection.

Also, embodiments of the invention may avoid the need for liquid cooling on the furnace. For example, none of the components near the furnace may require liquid cooling. This may reduce the chances of an explosion when water comes into contact with molten substance. Moreover, embodiments of the invention may at least be as efficient at melting as a conventional induction furnace. In addition, embodiments of the invention may be more efficient at melting aluminum than a conventional induction furnace, for example, because of aluminum's reduced melting temperature.

Embodiments of the invention may achieve a higher difference in the melting temperature of metal and the furnace walls when aluminum is used. For example, this aspect may be important to the furnace's ability to transfer energy into a metal, consistent with embodiments of the invention, the furnace may be designed to direct microwaves into proper material (e.g. absorption element) for heating. An efficient shape for the absorption element for absorbing microwaves may comprise, for example, a wedge shape with the thin edge facing the incoming microwaves. This wedge may be made of a material that is a good absorber of microwave energy. A good absorber may comprise a material that converts microwave energy into heat energy with minimal energy losses.

The absorption element for absorbing microwaves may be made of an absorbing material such as silicon carbide, for example. This material may absorb energy from both the magnetic field and electric field components of the microwave. The wedge shape of the silicon carbide absorption element may focus the energy from the microwaves into a specific point inside the absorption element. The material's electric properties along with the geometry may provide efficient microwave energy absorption.

The absorption elements may be insulated by insulating elements. The insulating elements may be made of a thermal insulation material that may be transparent to microwaves. This insulation material may be a good thermal and electrical insulator and may be a homogeneous material. For example, fused silica may be used to make the insulating elements because fused silica: i) has good electrical properties; ii) has a loss factor similar to that of air, which makes it transparent to Microwaves; and iii) has good thermal insulation characteristics. Furthermore, fused Silica may also withstand the temperatures required to melt metals.

Embodiments of the invention may also use a microwave generator comprising, for example, a power supply and a high power magnetron that creates the microwaves. The microwaves may then be directed to the furnace using various elements including a waveguide. Embodiments of the invention may provide a transition from the waveguide to the furnace without reflecting the microwaves off the fused silica insulation and without causing the microwaves to travel back to the microwave generator. This transition may facilitate energy transfer from the waveguide to the furnace and to simultaneously focus the microwave energy to obtain the desired shape before absorption.

FIG. 1 shows a microwave furnace 100 consistent with embodiments of the invention. Microwave furnace 100 may comprise a refractory assembly 105, a microwave generator 110, wave guides 115, and power transfer elements 120. Refractory assembly 105 and power transfer elements 120 may comprise a melter assembly consistent with embodiments of the invention.

Figure 2:
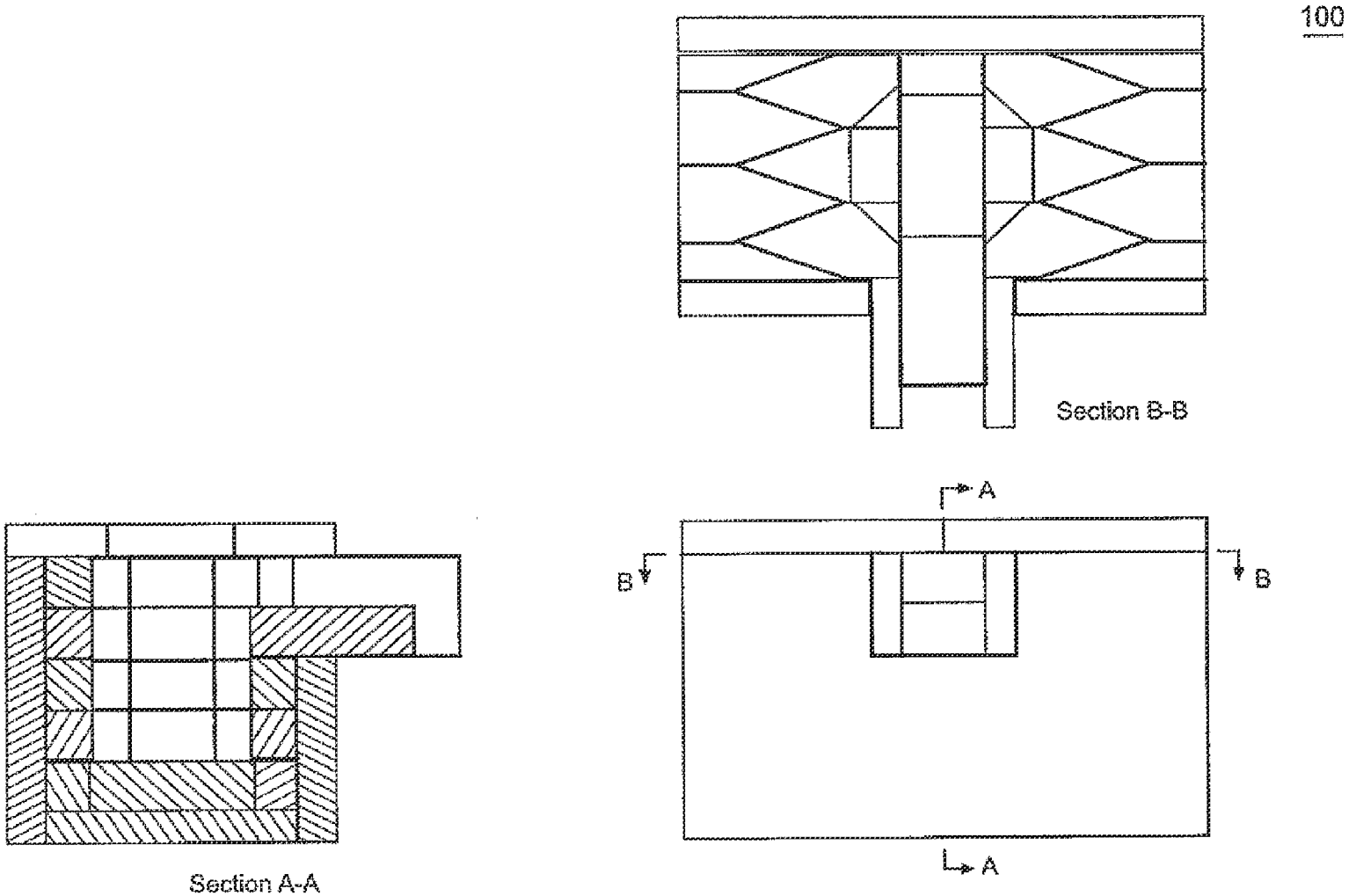
FIG. 2 shows a refractory assembly.
Figure 3:
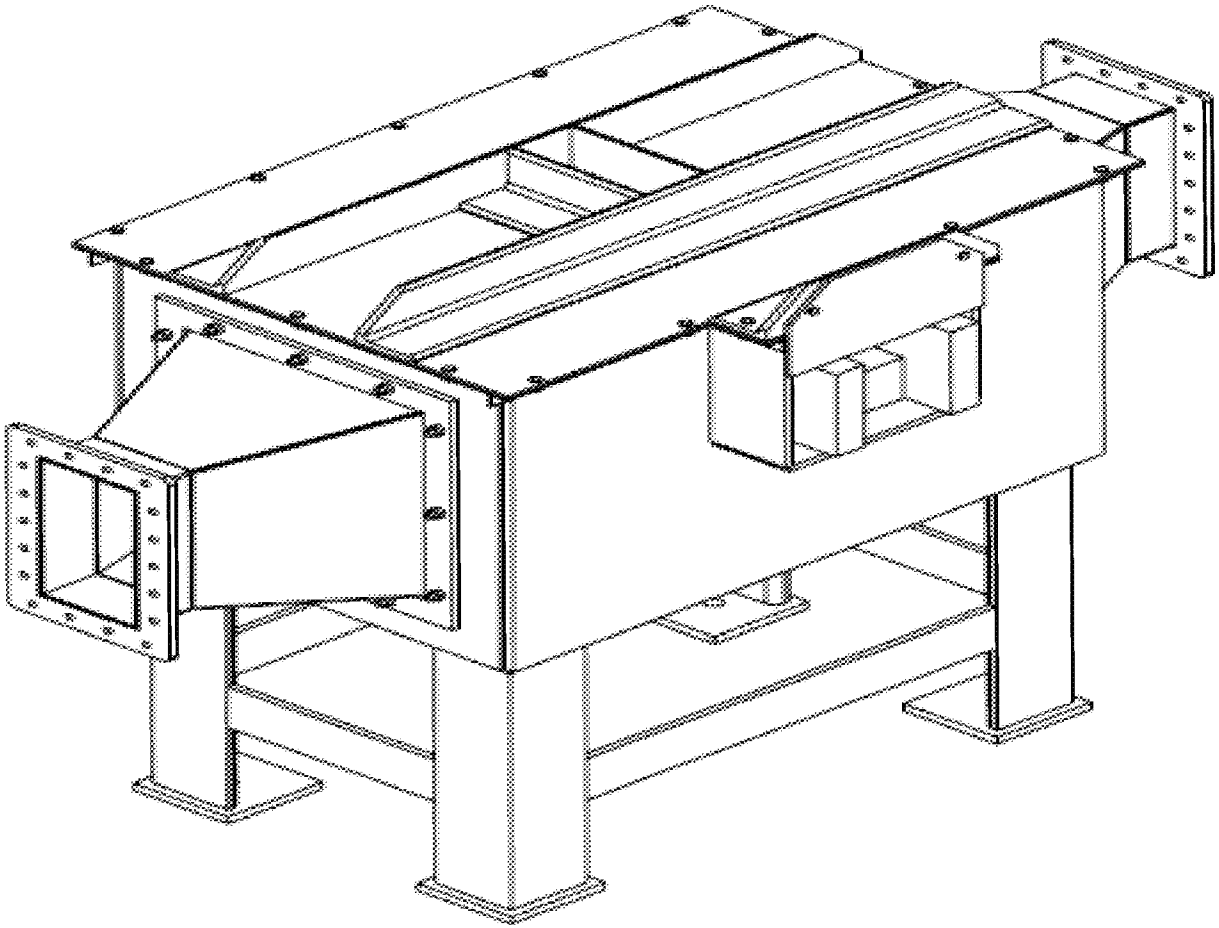
FIG. 3 shows a melter assembly.
Figure 4:
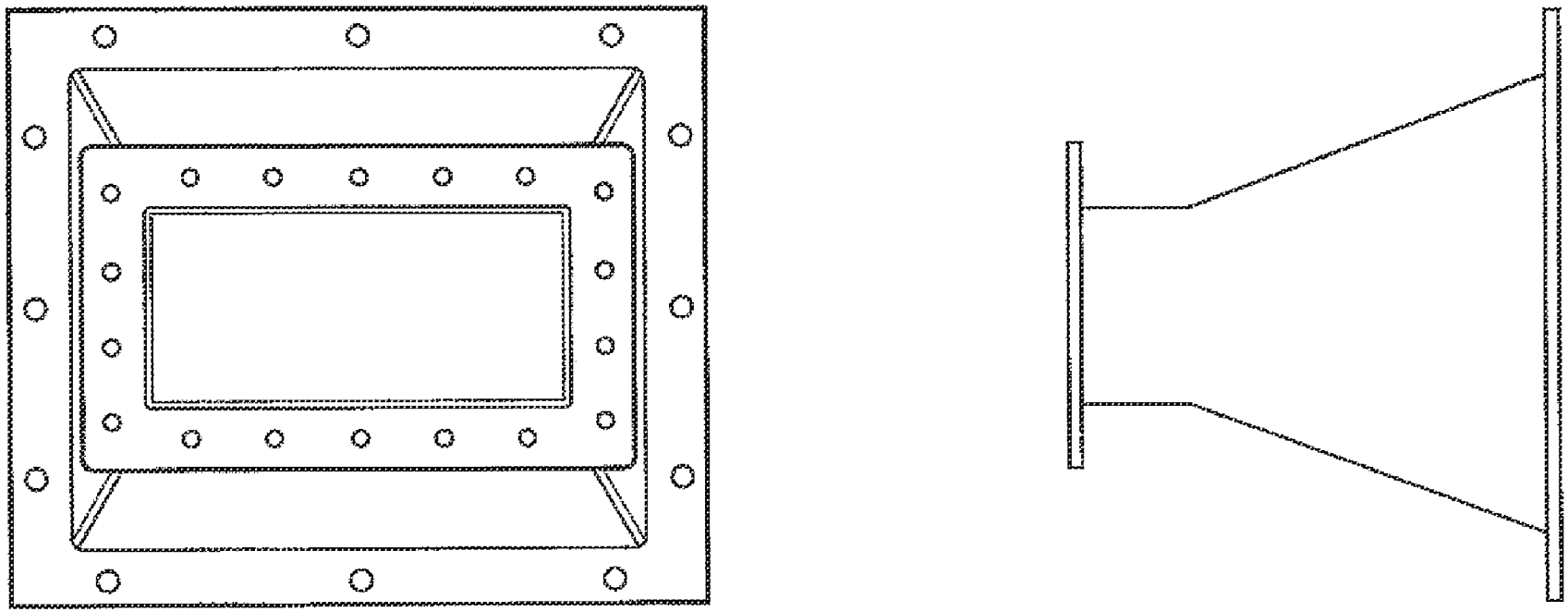
FIG. 4 shows power transfer elements.
Figure 5:
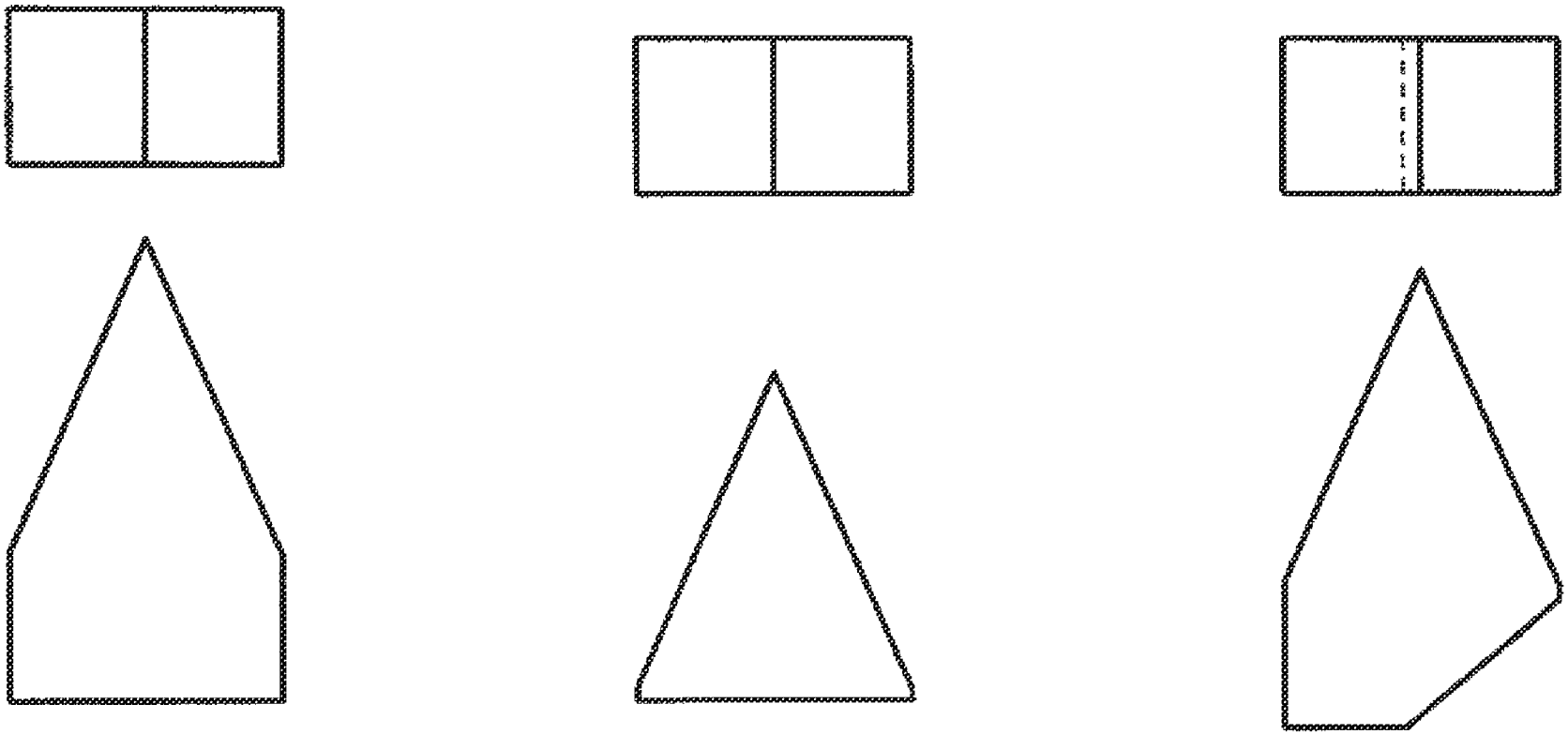
FIG. 5 shows examples of absorption elements.

FIG. 2 shows refractory assembly 105 in more detail. The silicon carbide parts (e.g. absorption elements) may be cast into one complete piece to avoid potentials for leaks. The fused silica shapes (e.g. insulation elements) may remain as individual bricks as shown. Refractory assembly 105 may be placed into the melter assembly as shown in FIG. 3. As shown in FIG. 3, power transfer elements 120 may be placed on the sides. Power transfer elements 120 may provide transfer from wave guides 115 to refractory assembly 105. Refractory assembly 105 may include cold metal addition window on the top and the hot metal pour spout on the front. Both may be designed to allow metal to enter and leave furnace 100 and at the same time prevent microwave energy from escaping. FIG. 4 shows power transfer elements 120 in more detail. FIG. 5 shows examples of the aforementioned absorption elements (e.g. wedge shaped silicon carbide).

Figure 6:
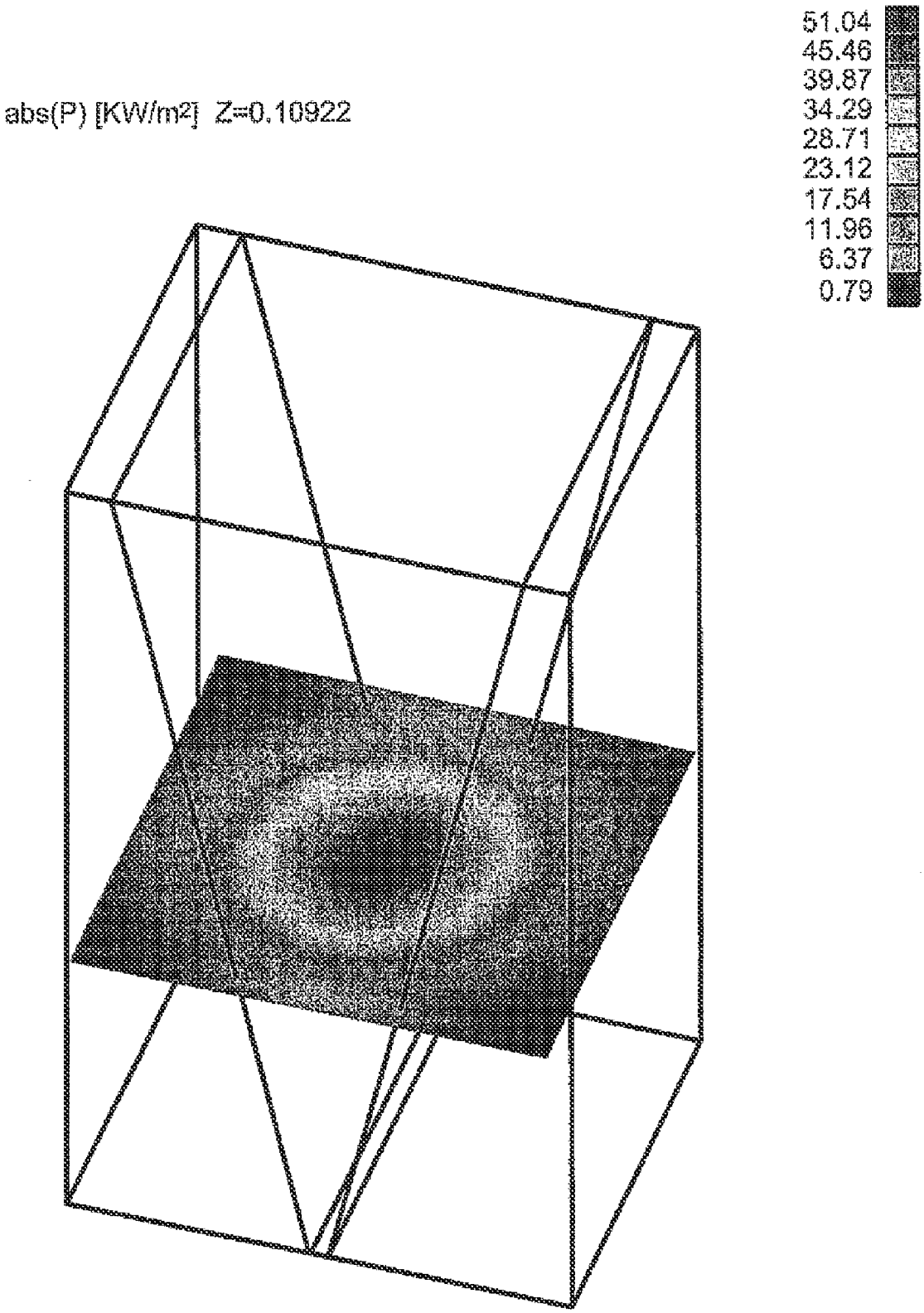
FIG. 6 shows an energy absorption simulation for absorption elements.
Figure 7:
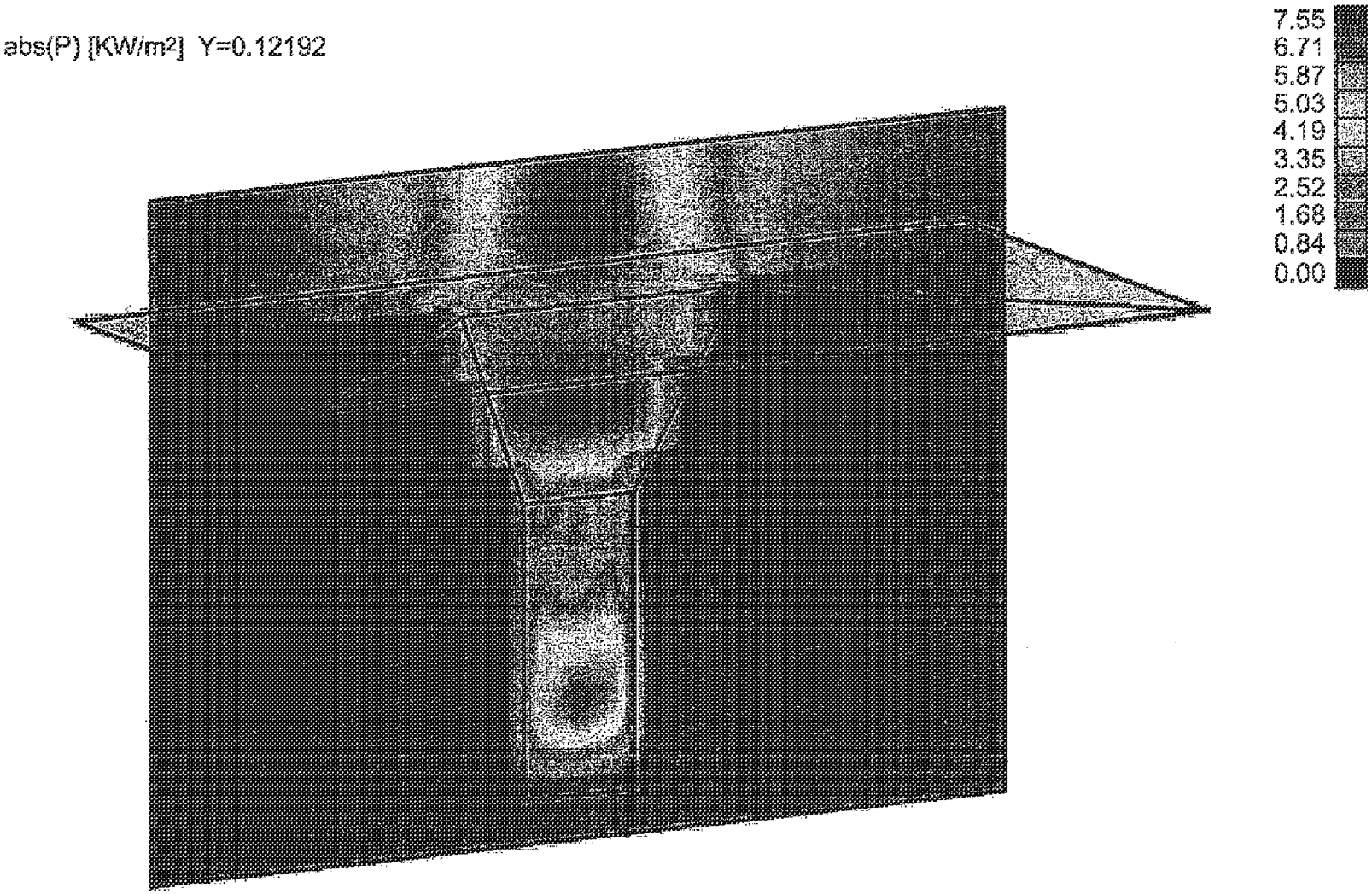
FIG. 7 shows a focal pattern of microwaves as they enter a melter assembly.

FIG. 6 shows energy absorption simulation of the aforementioned absorption elements. FIG. 6 illustrates a focusing effect of the silicon carbide wedge bricks and the power transfer assembly. The wedge shape was simulated and the focusing effect was confirmed. FIG. 7 shows the focal pattern of the microwaves as they enter the melter assembly.

Figure 8:
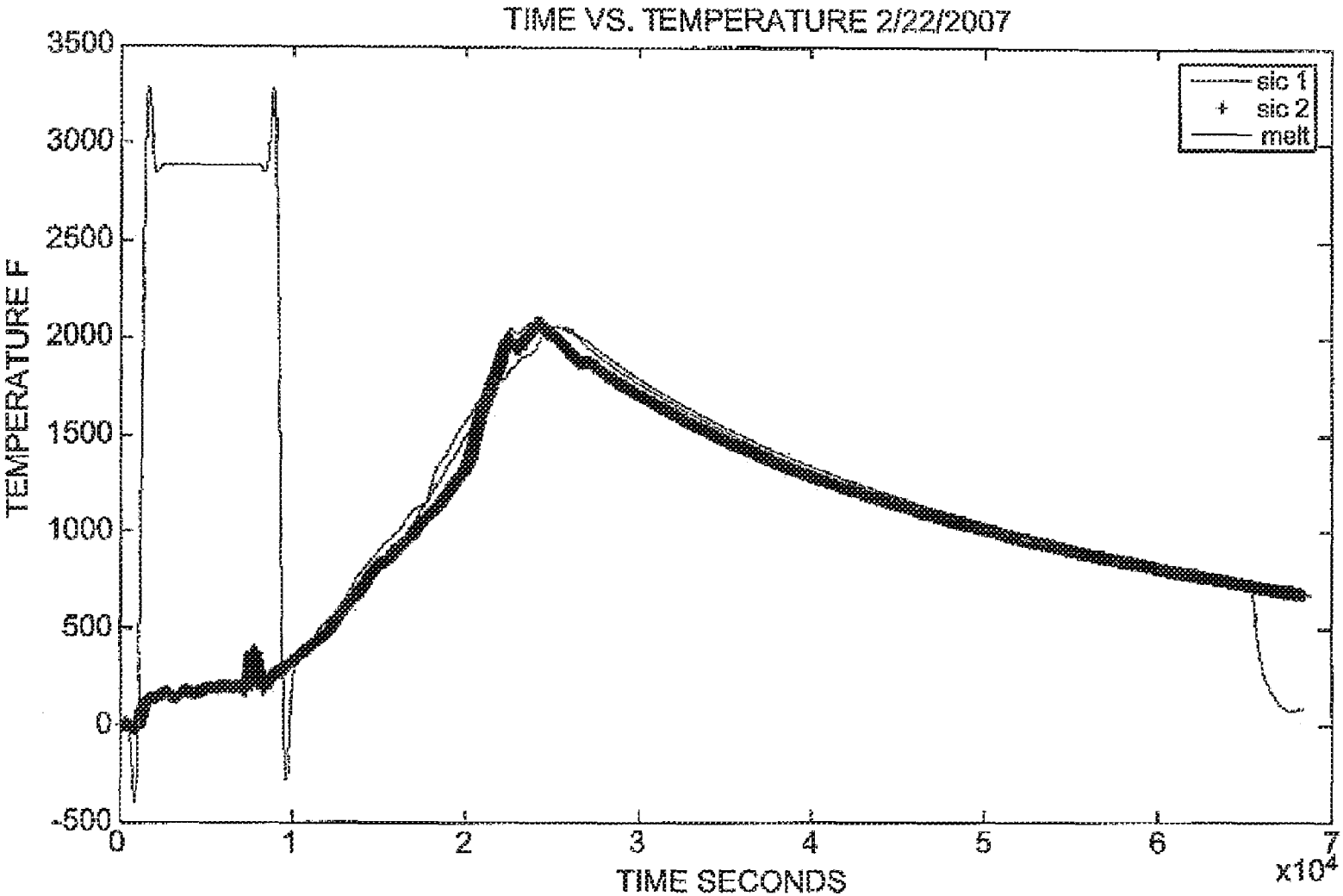
FIG. 8 shows a graph of temperature results for curing the microwave furnace.

FIG. 8. shows, for example, a graph of temperature results for curing microwave furnace 100. The test data may include the following:

Time to Heat Furnace to Melting Temp

Overall Melting Efficiency $$\text{Defined as } \frac{E_{Cu}}{E_{Gen}} * 100\%$$

$E_{Cu}$=Theoretical energy to melt set amount of copper $E_{Gen}$=Amount of energy consumed by microwave generator Microwave to Melted Copper Efficiency Defined as $\frac{E_{Cu}}{E_{Wg}} * 100\%$ $E_{Wg}$=Microwave energy delivered to furnace In the test shown in FIG. 8, the furnace did reach the required temperature to cure the refractory mortar. The furnace, exceeded melt point for copper Preliminary analysis revealed the following:

$T_1$=Time copper was inserted into furnace.

$T_2$=Time copper was melted

ΔT=Total time required to melt the copper in seconds.

Average watts*ΔT=$J_1$=joules of energy used.

$J_c$=Amount of energy required to melt x lbs of copper.

$$\frac{Jc}{J_1} * 100\% = \text{efficiency of melting copper.}$$

In the test shown in FIG. 8, using this formula and 45 lbs of copper, the efficiency of the melting apparatus was approximately 60% from MW energy to melted copper and 48% from electrical energy to melted copper.

Figure 9:
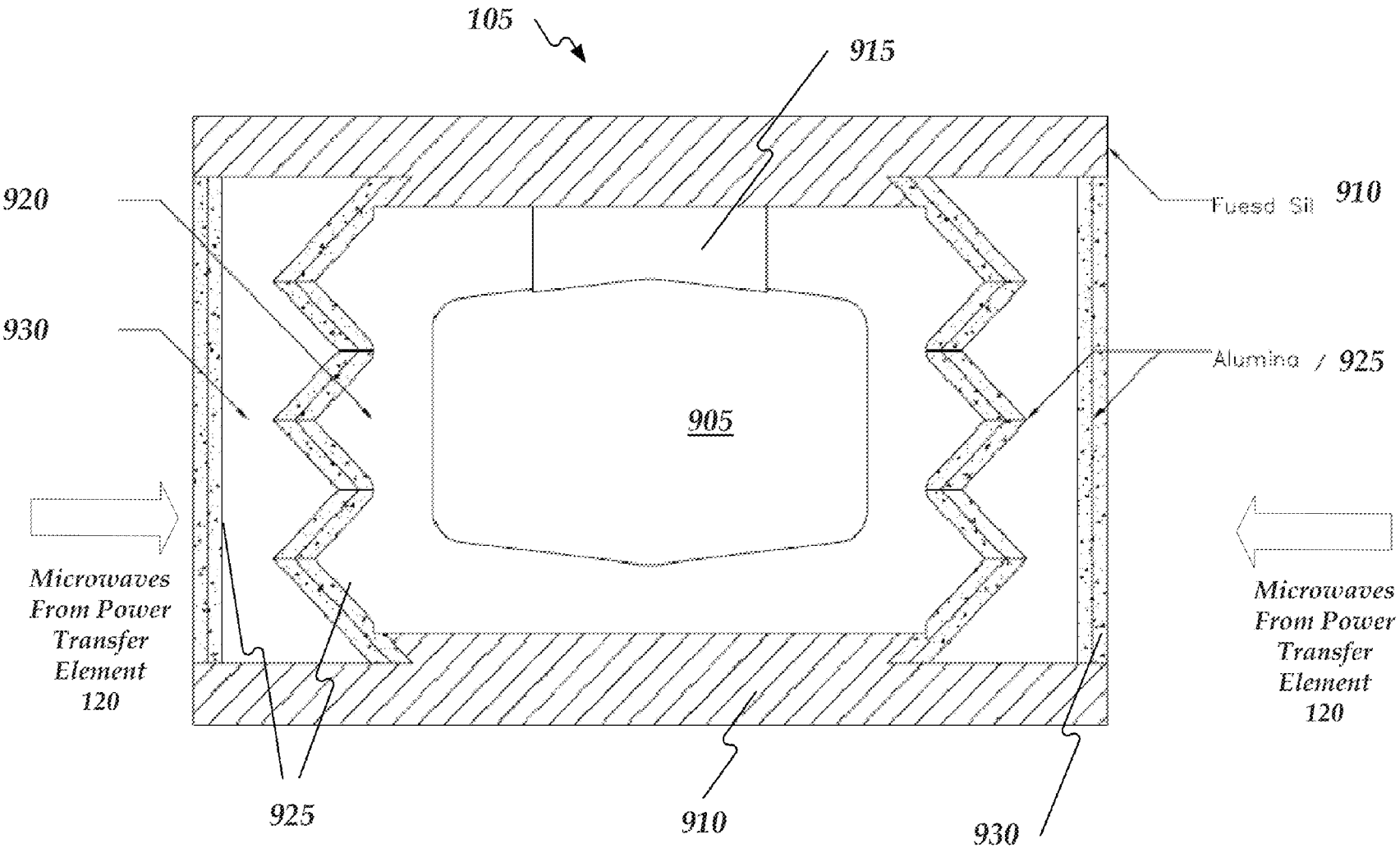
FIG. 9 shows a refractory assembly.

FIG. 9 shows other embodiments of refractory assembly 105. As shown in FIG. 9, refractory assembly 105 may comprise a crucible 905, insulation elements 910, a spout 915, an absorption element 920, boards 925, and gaps 930. Microwave energy may be received from power transfer elements 120 as shown in FIG. 9. Absorption element 920 may comprise silicon carbide, insulation elements 910 may comprise fused silica, and gaps 930 may comprise sealed air gaps. Insulation elements 910 may be configured to insulate heat into crucible 905.

Boards 925 may comprise silica and alumina fiberboards that may be arranged in assembly 105 so as to present the least amount of material to the microwaves, but still provide adequate thermal insulation. Boards 925 may be placed outside a zone of the highest electromagnetic energy density in assembly 105. Gaps 930 between some of boards 925 may facilitate energy removal from the boards 925. While no material may be perfectly microwave transparent, any losses that may occur in the material must be dissipated somewhere. For example, boards 925 that are furthest away from absorption element 920 may radiate any losses into power transfer elements 120 and into a furnace shell containing refractory assembly 105. Boards 925 that are attached to crucible 905 may conduct their energy into crucible 905.

Silicon carbide parts (e.g. absorption element 920) may be cast into one complete piece to avoid potentials for leaks. Fused silica parts (e.g. insulation elements 910) may remain as individual bricks. Refractory assembly 105 may be placed into the melter assembly as described above with respect to FIG. 3. As shown in FIG. 3, power transfer elements 120 may be placed on the sides of assembly 105. Power transfer elements 120 may provide transfer from wave guides 115 to refractory assembly 105. Refractory assembly 105 may include a cold metal addition window on the top and a hot metal pour spout (e.g. spout 915) on the front. Both may be designed to allow metal to enter and leave furnace 100 and at the same time prevent microwave energy from escaping.

Consistent with embodiments of the invention, microwave furnace 100 may be used to perform a continuous melting process. For example, microwaves from microwave generator 110 may be transmitted through wave guides 115 to power transfer elements 120. As described above, the microwaves may be converted to heat and metal in crucible 905 may be melted by the heat. Refractory assembly 105 may include a cold metal addition window on the top and a hot metal pour spout (e.g. spout 915) on the front. Consequently, the continuous melting process may allow metal to enter (e.g. through cold metal addition window) and leave (e.g. through spout 915) microwave furnace 100 and at the same time prevent microwave energy from escaping. Power transfer elements 120 may be configured to match impedance between wave guides 115 and refractory assembly 105 to maximize energy transfer from wave guides 115 to refractory assembly 105. The continuous melting process may be controlled by a computer running a program module. Among other things, the program module may monitor and/or control the microwaves generated by microwave generator 110 and the amount of metal entering and leaving microwave furnace 100.

FIG. 10 through FIG. 13 show other embodiments of the present invention that may include a burner probe 1005. As will be described below, burner probe 1005 may be placed in a crucible containing metal in order to melt the metal. Burner probe 1005 may be placed in the crucible from the top, the bottom, the side, or from any angle. Because probe 1005 may be used to convert microwave energy into heat, a temperature gradient in the crucible itself may be avoided due to the heat being transferred from probe 1005 to the metal rather than heat being transferred from the crucible to melt the metal. Mitigating the temperature gradient may avoid cracks in the crucible. Furthermore, because probe 1005 may heat the metal from the inside out, microwaves and heat may not have to pass through material insulating the crucible. In this way, overheating or melting the material insulating the crucible may be avoided. Also, because burner probe 1005 may be placed directly in the metal, the metal may dissipate and absorb all or nearly all of the energy transmitted by probe 1005 allowing high energy efficiency. Burner probe 1005 may compromise a geometry configured to minimize microwave energy reflection, thus maximizing energy absorption into the material being melted.

Figure 10:
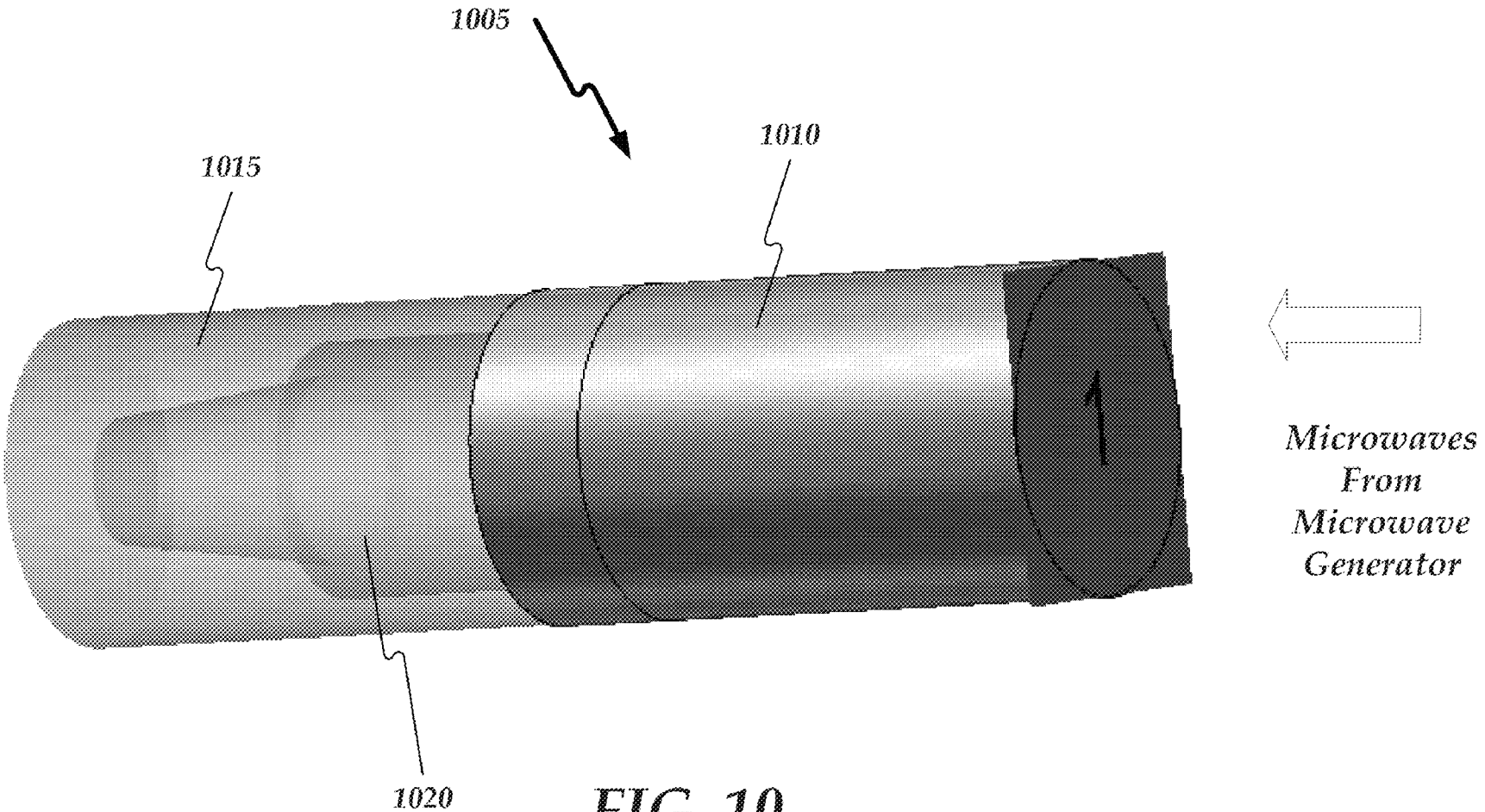
FIG. 10 shows a burner probe.

FIG. 10 shows microwave burner probe 1005. Burner probe 1005 may convert microwave energy to heat energy. Burner probe 1005 may comprise an insulator 1020 and a wave guide 1010 (e.g. may be circular and metallic). Wave guide 1010 may be configured to transport microwave energy to an absorber 1015. Absorber 1015 may absorb microwaves and may dissipate energy from the absorbed microwaves as heat. The heat may be dissipated into the crucible to melt metal in the crucible. Absorber 1015 may have a geometry such that a minimal amount of microwave energy is reflected back into wave guide 1010.

Figure 11A:
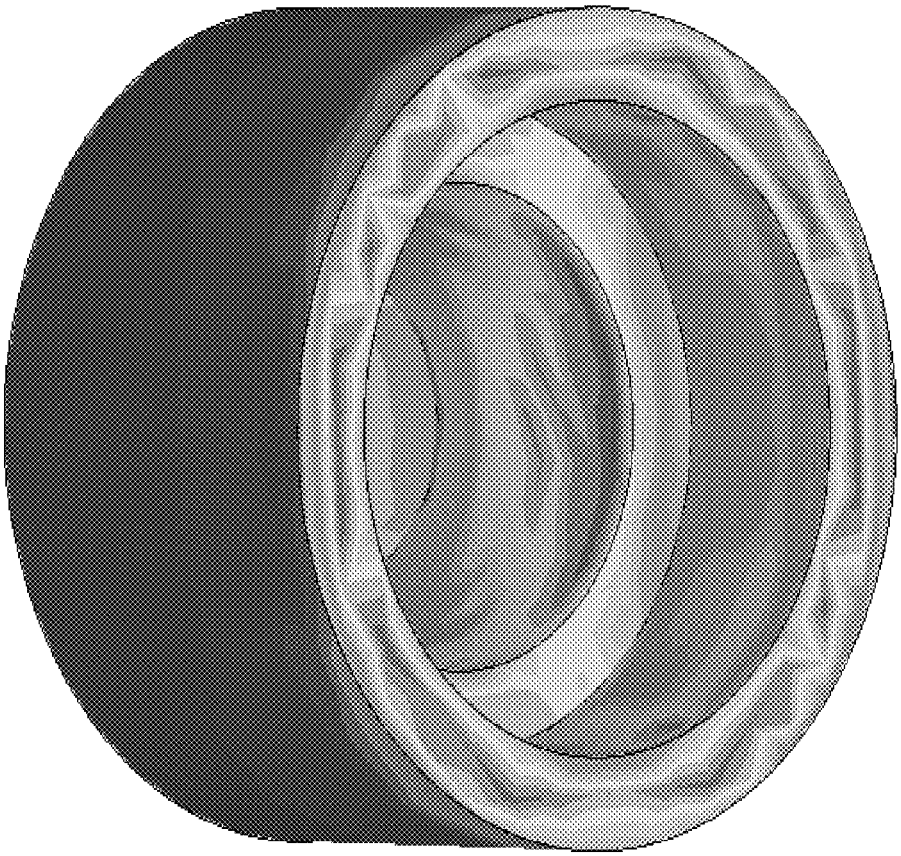
FIGS. 11A and 11B show a computed thermal dissipation profile of the burner probe.
Figure 11B:
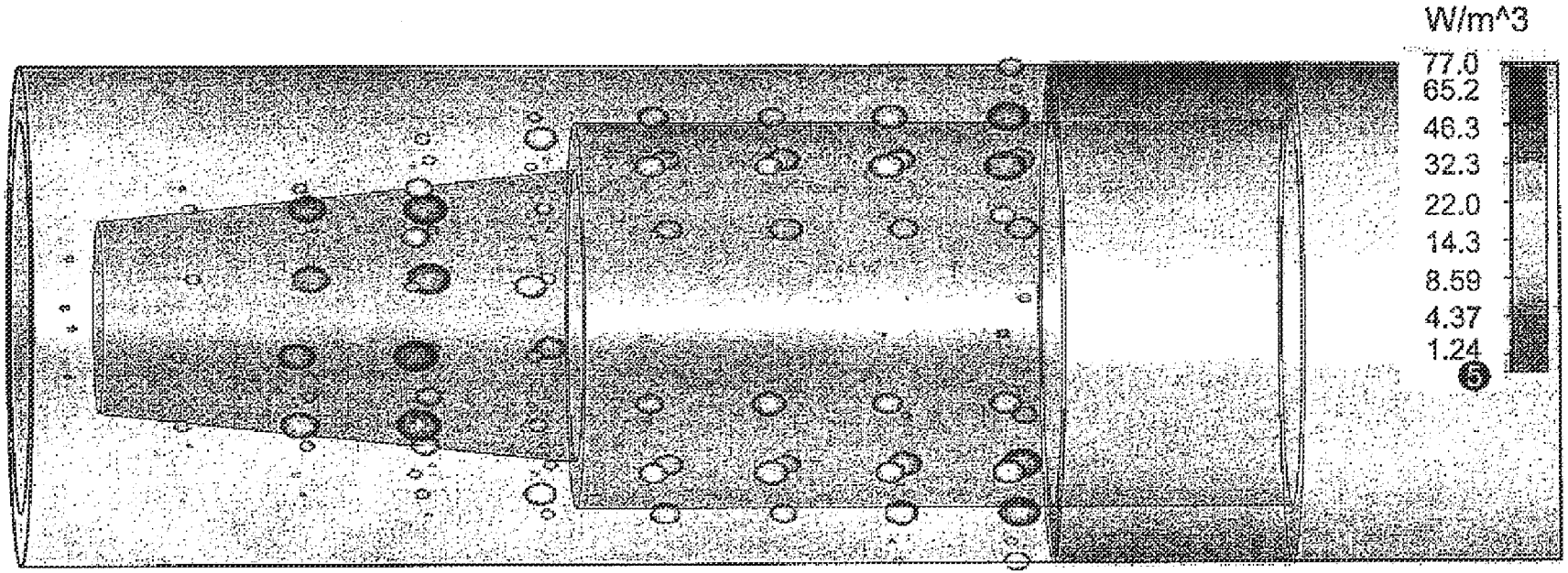

FIGS. 11A and 11B show a computed thermal dissipation profile for burner probe 1005 of FIG. 10. The profile shows the position of the thermal energy being generated by microwaves in burner probe 1005. In general, FIGS. 11A and 11B show the heat being generated in a mid section of burner probe 1005. FIG. 11A shows the internal dissipation from a surface contour standpoint. FIG. 11B shows how the energy is dissipated in the profile with the bubbles indicating the general location and relative amount of heat dissipated. Heat may be dissipated all along the exterior of absorber 1015.

Figure 12:
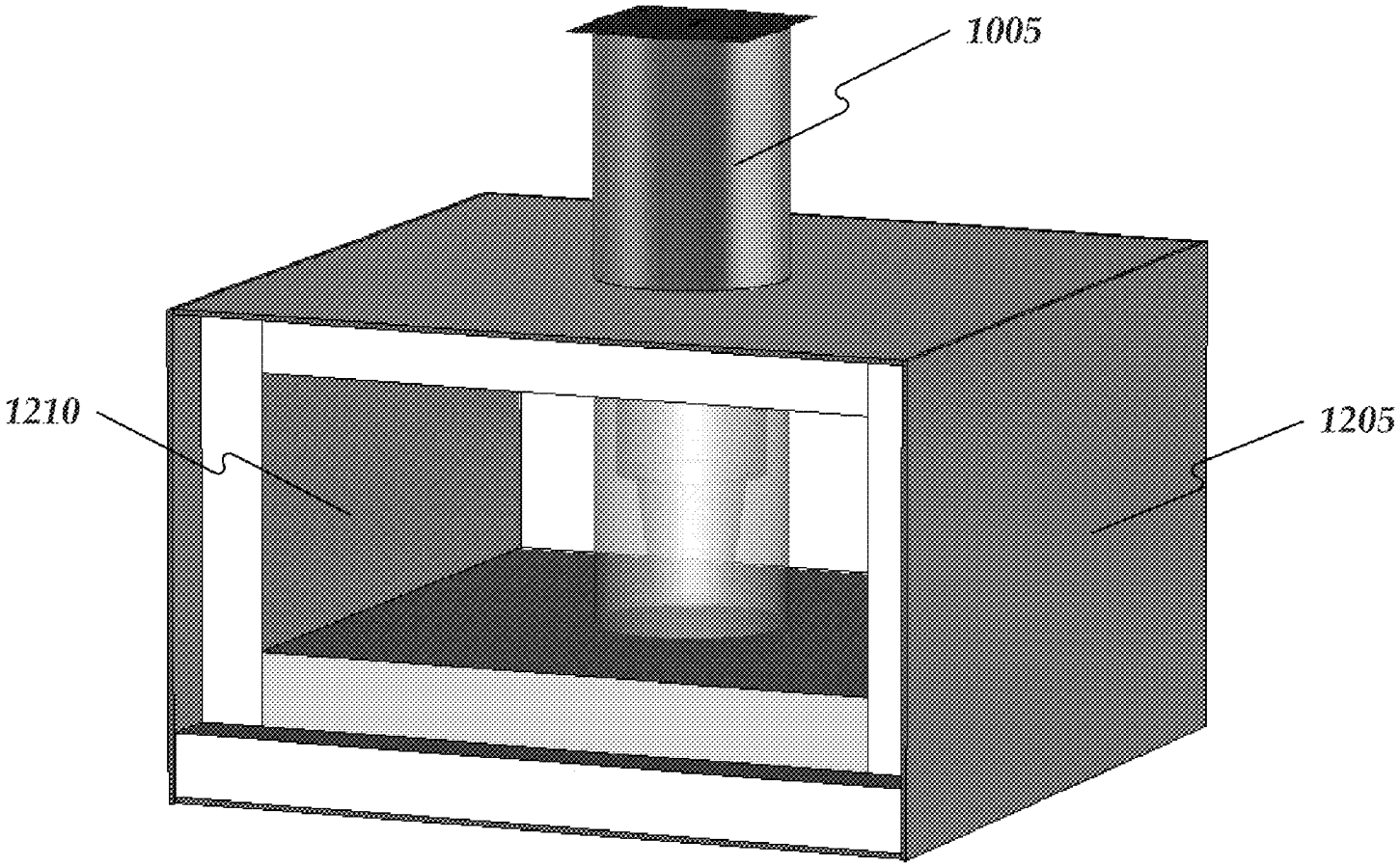
FIG. 12 shows a vertical immersion furnace.

FIG. 12 shows embodiments of the invention that may include a vertical immersion of burner probe 1005 into a crucible 1210 of a furnace 1205. As shown in FIG. 12, burner probe 1005 may be inserted into furnace 1205 from the top. Furnace 1205 may include a spout (not shown) and may be used in a continuous melting process where material is continuously placed in furnace 1205 through a metal addition window (not shown) and molten metal exits the spout. Furthermore, a plurality of burner probes (not shown) similar to burner probe 1005 may be used. When the plurality of burner probes are used, one of the pluralities of burner probes may be taken down and repaired without having to stop production on furnace 1205.

Figure 13:
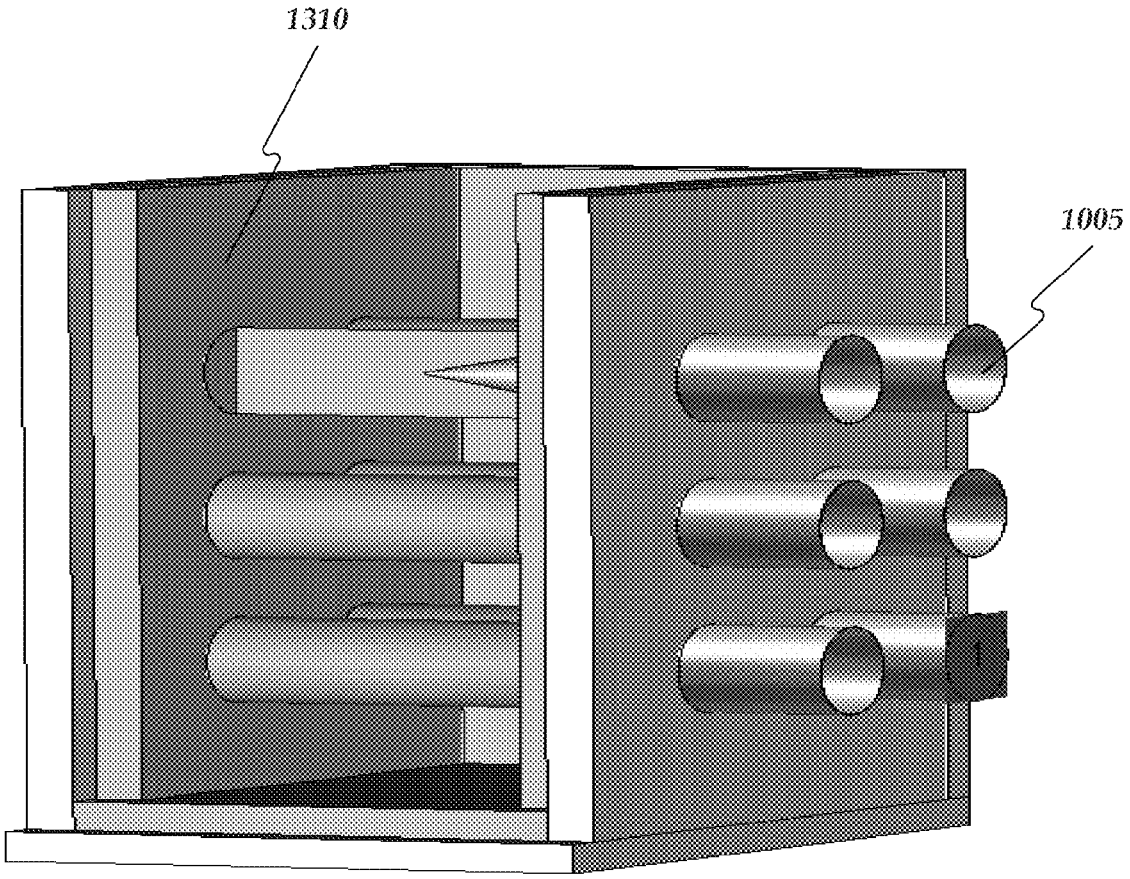
FIG. 13 shows a horizontal immersion furnace.

FIG. 13 shows horizontal immersion consistent with embodiments of the invention. As shown in FIG. 13, probes (e.g. each comprising burner probe 1005) may be inserted into a crucible 1310 from the sides. Consistent with embodiments of the invention, probes may be inserted from any direction or angle. In embodiments comprising multiple probes, all probes may be inserted from any direction or ones of the probes may be inserted from different directions.

Figure 21:
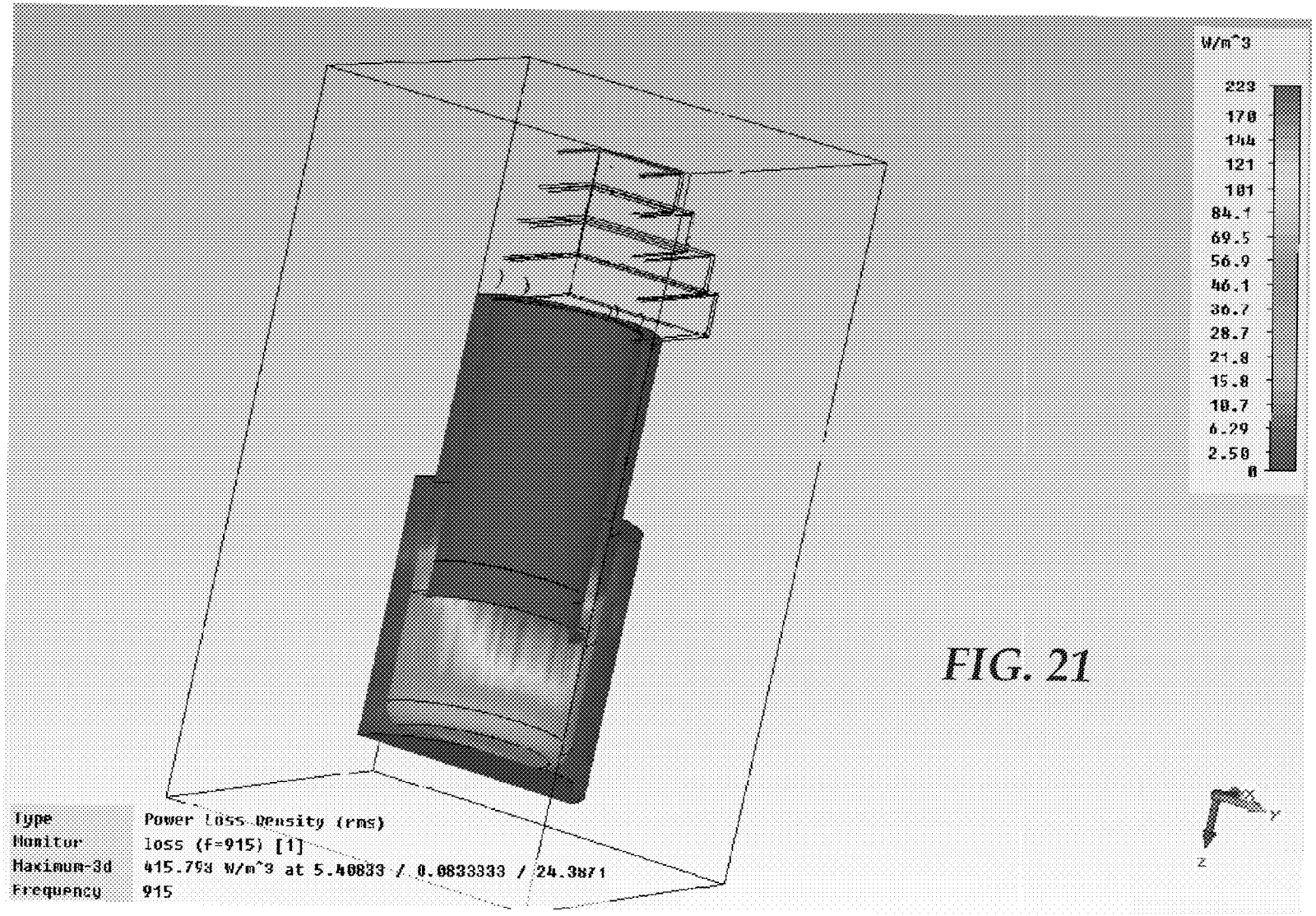
FIG. 21 shows modeling results indicating the formation of hot spots.

Consistent with embodiments of the invention, microwaves may be carried inside a waveguide. The waveguides may be rectangular or round, for example. A transition from a rectangular waveguide to a round waveguide, however, may leave a resulting pattern in the round waveguide stationary. Consistent with embodiments of the invention, a wave pattern in a round waveguide may rotate with respect to, for example, a stationary waveguide. Rotating the round waveguide may not rotate the microwave pattern inside the round waveguide. Embodiments of the present invention may rotate the wave pattern inside the round waveguide without, for example, moving the round waveguide. Rotating the wave pattern inside the round waveguide may allow heat generated by the microwaves to spread out evenly across the surface of a probe connected to the round waveguide. This may allow more energy to be delivered to the probe and may limit or eliminate hot spots in the probe. FIG. 21 shows modeling results indicating the formation of hot spots. As shown in FIG. 21, hotter areas and cooler areas are shown.

Figure 14:
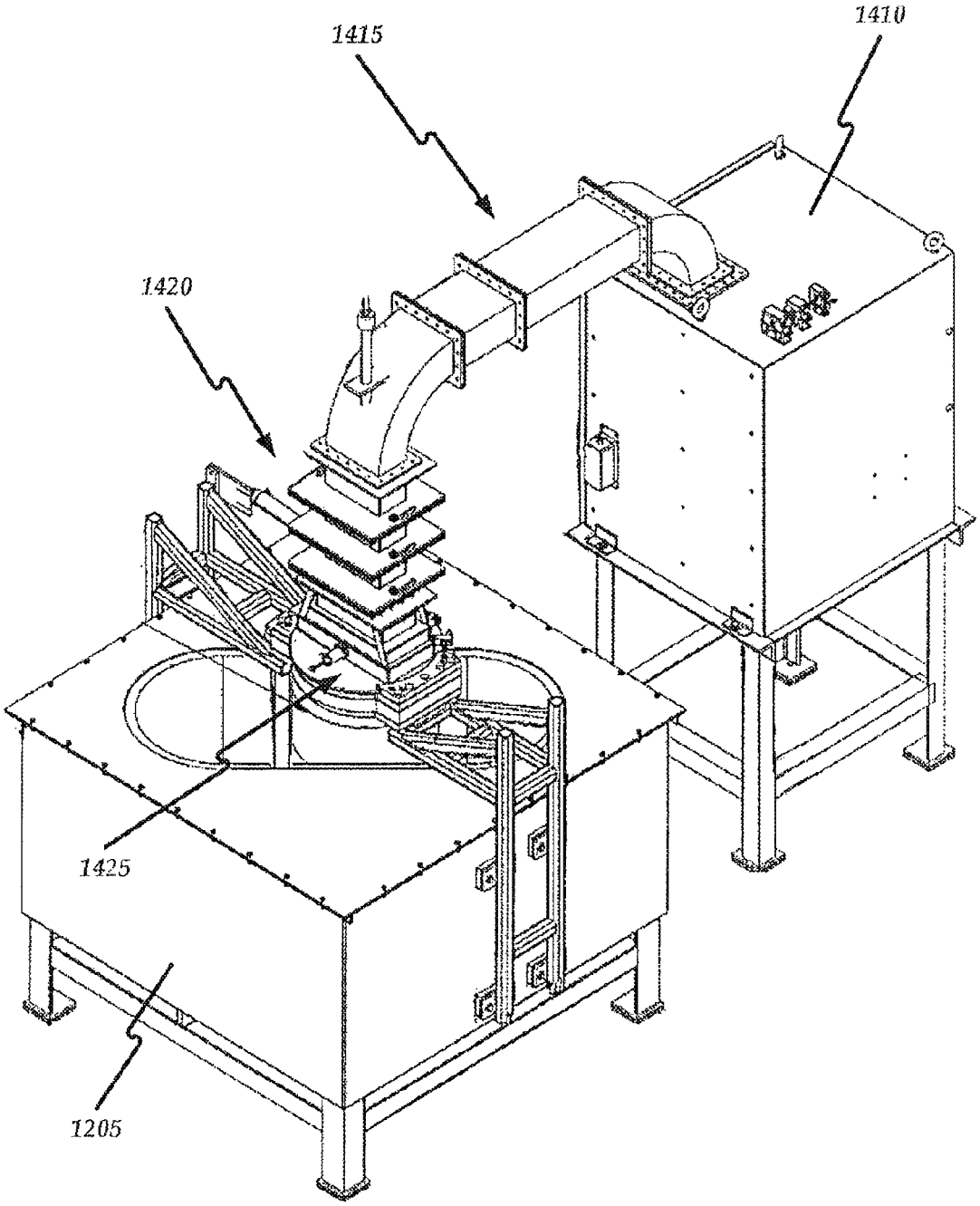
FIG. 14 shows a substance melting system.
Figure 15:
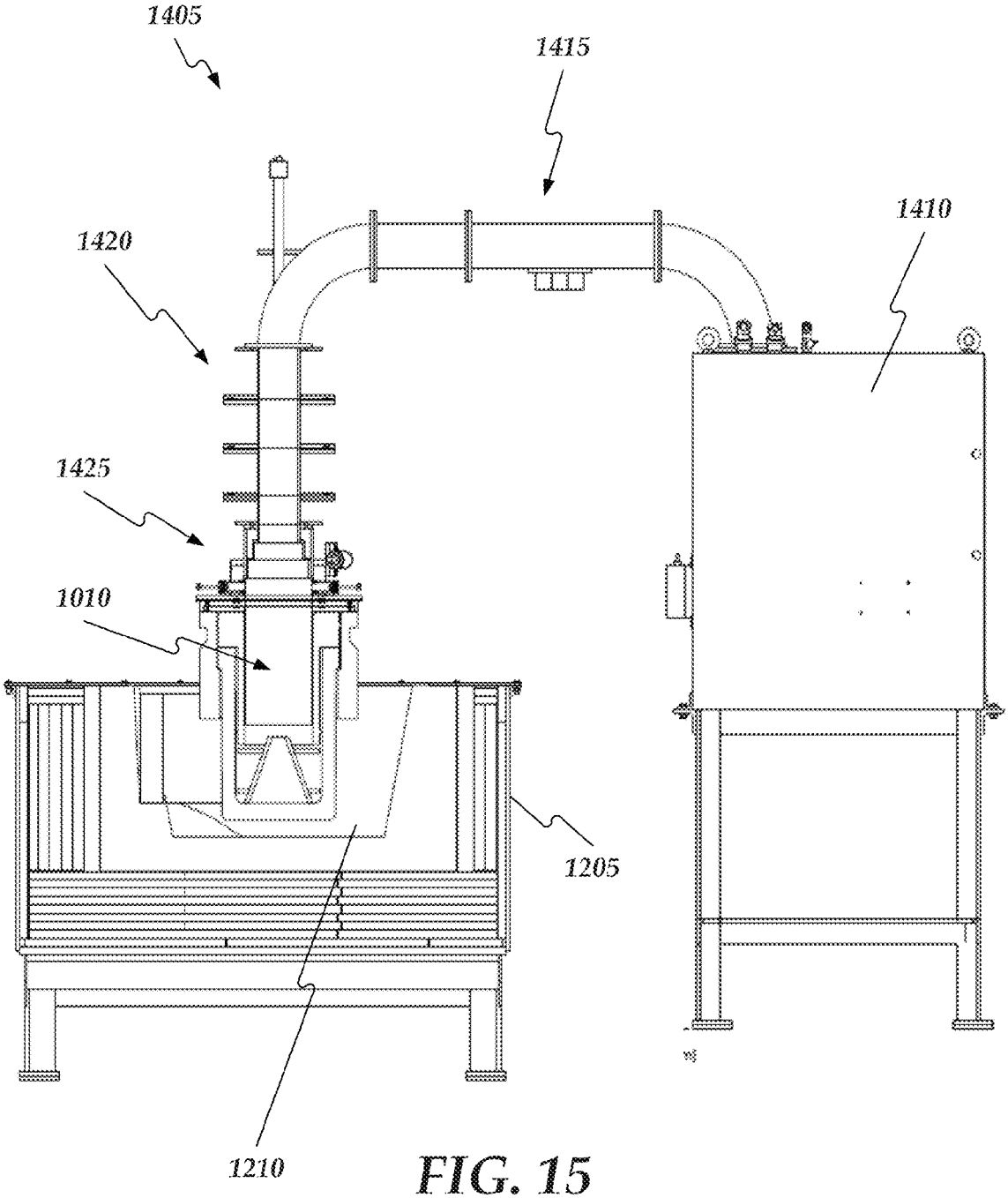
FIG. 15 shows a side view of the substance melting system from FIG. 14.

FIG. 14 shows a substance melting system 1405. As shown in FIG. 14, substance melting system 1405 may comprise a microwave generator 1410, a second wave guide 1415, a rotating wave guide 1420, a transition piece 1425, and a furnace 1205. FIG. 15 shows a side view of substance melting system 1405 from FIG. 14. Microwaves may be generated by microwave generator 1410. After the microwaves are generated, they may pass through second wave guide 1415, rotating wave guide 1420, and transition piece 1425. After the microwaves pass through transition piece 1425, they may pass into a first wave guide (e.g. wave guide 1010) where they may be converted into heat. This created heat may then pass through the exterior of burner probe 1005 into crucible 1210. The created heat may melt a substance in crucible 1210.

In substance melting system 1405, a transition from a waveguide having a first geometry to another wave guide having a second geometry may occur. For example, a transition from a rectangular waveguide (e.g. second wave guide 1415) to a round waveguide (e.g. first wave guide, wave guide 1010) may occur. If nothing else is done, however, this arrangement may leave a resulting pattern, for example, in the round waveguide stationary. Consistent with embodiments of the present invention, the microwave pattern inside wave guide 1010 (e.g. first wave guide) may be rotated without, for example, moving wave guide 1010. Rotating the wave pattern inside wave guide 1010 may allow heat generated by the microwaves to spread out evenly across burner probe 1005 connected to wave guide 1010. This may allow more energy to be delivered to burner probe 1005 and may limit or eliminate hot spots in burner probe 1005.

Consistent with embodiments of the invention, in order to rotate the microwave's pattern delivered from microwave generator 1410 trough second wave guide 1415, rotating wave guide 1420 may be placed between second wave guide 1415 and wave guide 1010 (e.g. first wave guide). Rotating wave guide 1420 may be manipulated to rotate the microwave pattern inside wave guide 1010, which in turn may allow heat generated by the microwaves to spread out evenly across burner probe 1005 connected to wave guide 1010.

Figure 16:
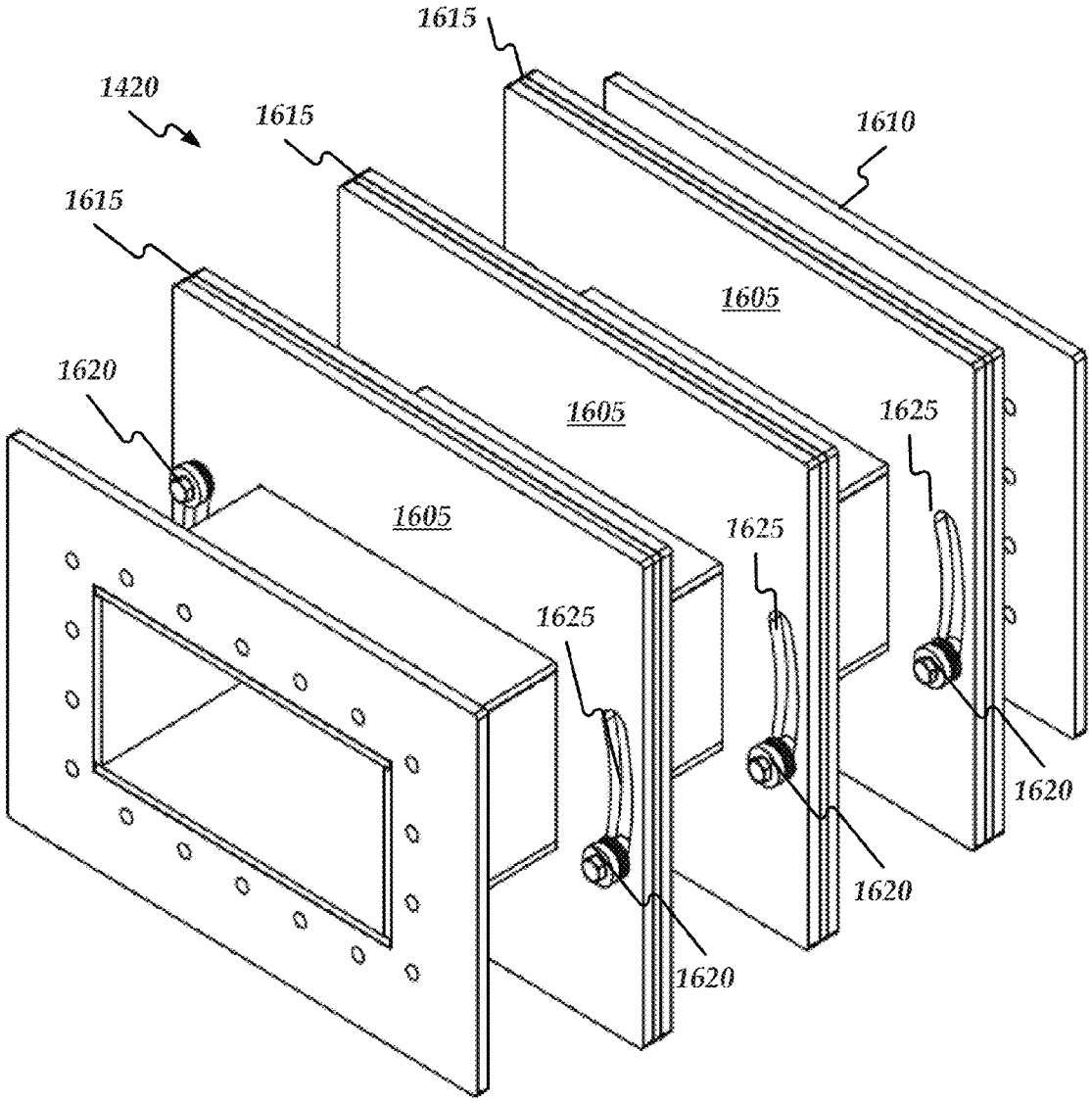
FIG. 16 shows a rotating wave guide.

FIG. 16 shows rotating wave guide 1420 in more detail. In order to rotate, rotating wave guide 1420 may comprise a plurality of sections configured to rotate about a central axis. Rotating wave guide 1420 may be configured to rotate 90 degrees, but may rotate through any angle measure. For example, rotating wave guide 1420 may comprise a plurality of sections 1605 and a fixed piece 1610. Each of sections 1605 may rotate 30 degrees about a central axis of rotating wave guide 1420. Between each of plurality of sections 1605 and between fixed piece 1610 and a bottom one of plurality of sections 1605 may be a respective one of a plurality of wear plates 1615. Also, to limit or prevent any microwave leakage, connections in substance melting system 1405 (including rotating wave guide 1420) may include electromagnetic interference (EMI) gaskets to seal joints and connections.

Figure 17:
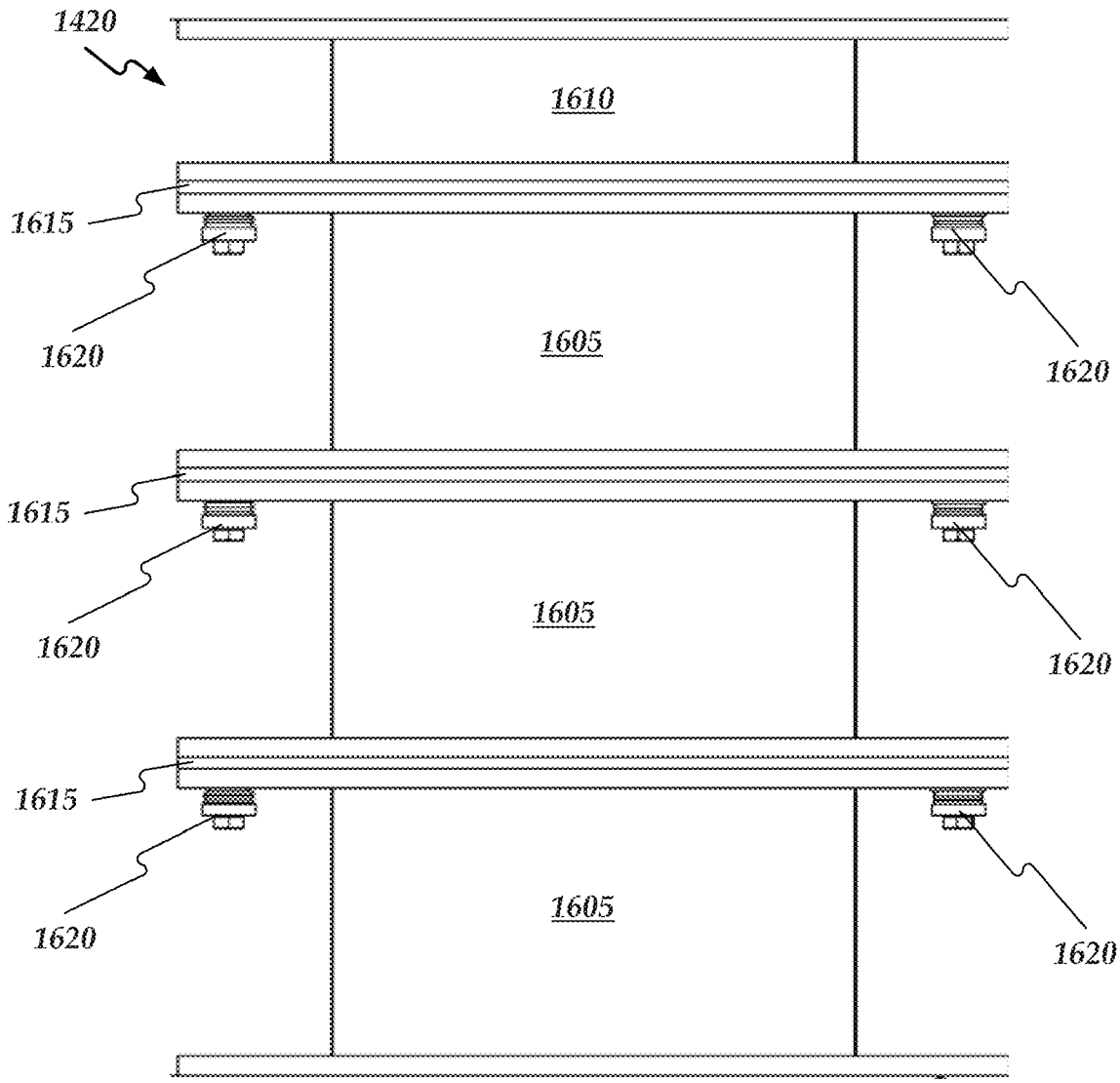
FIG. 17 shows a top view of the rotating wave guide from FIG. 16.
Figure 18:
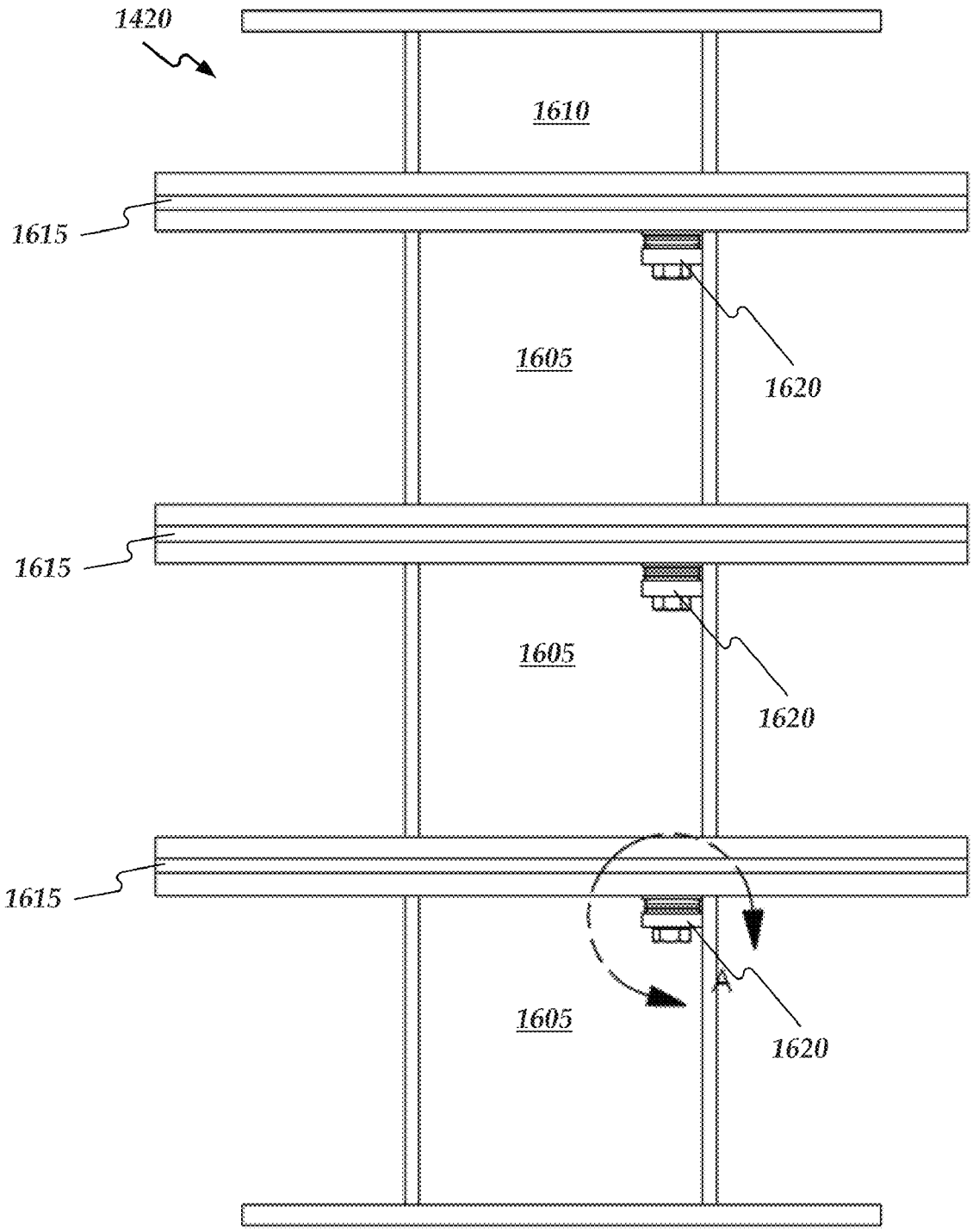
FIG. 18 shows a side view of the rotating wave guide from FIG. 16.

Joints between each of plurality of sections 1605 and between fixed piece 1610 and bottom one of plurality of sections 1605 may be held tightly together, for example, by spring forces that may be exerted by ones of plurality of bolts 1620 that may be spring-loaded. As plurality of sections 1605 rotate, ones of plurality of bolts 1620 may ride from one end of their corresponding plurality of slots 1625 to an opposite end of their corresponding plurality of slots 1625. FIG. 17 shows a top view of rotating wave guide 1420 from FIG. 16 and FIG. 18 shows a side view of rotating wave guide 1420 from FIG. 16.

Figure 19:
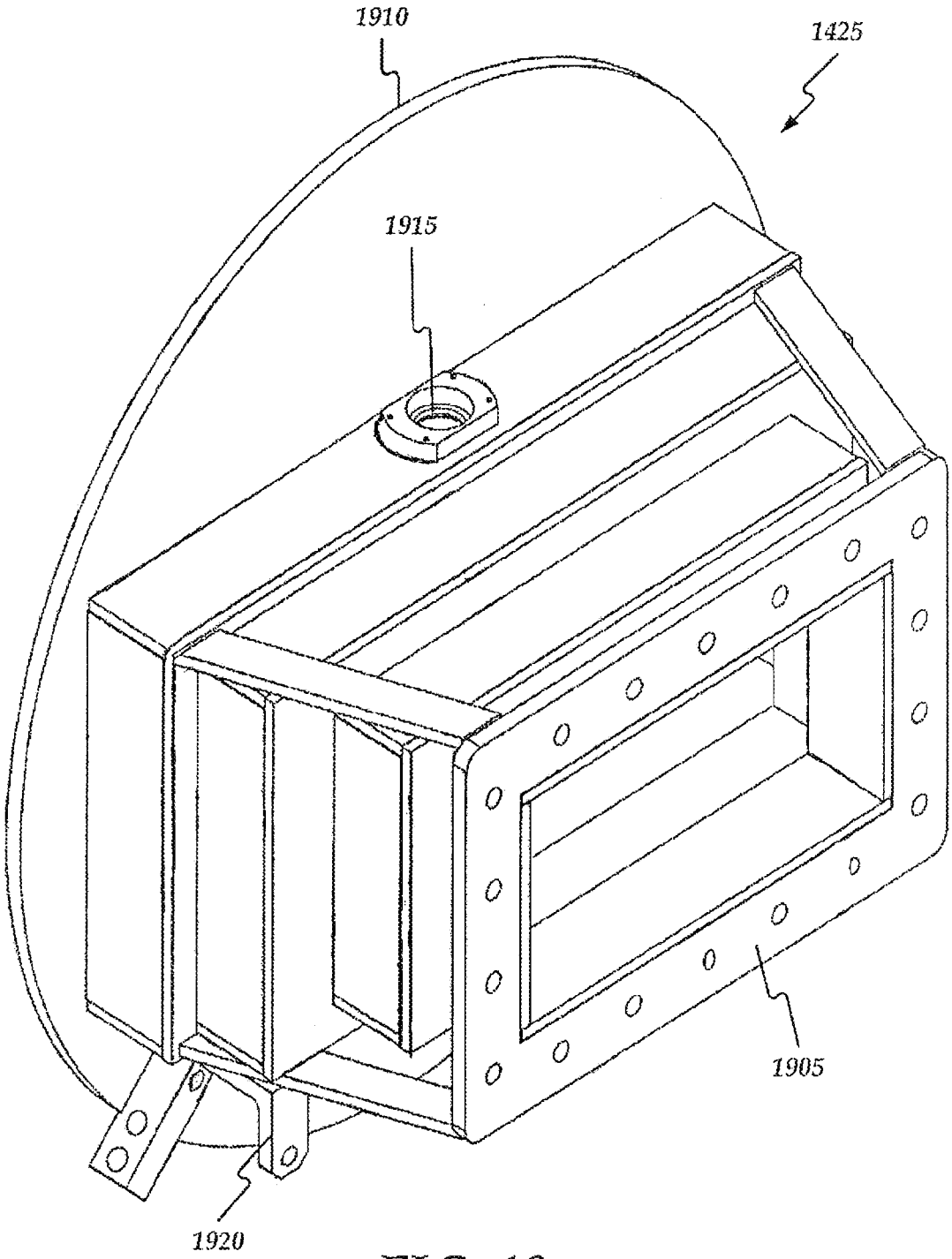
FIG. 19 shows a transition piece.

As stated above, embodiments of the invention may include two parts that work to rotate the microwave pattern. The first part may comprise rotating wave guide 1420 and the second part may comprise transition piece 1425. As shown in FIG. 19, transition piece 1425 may comprise a top end 1905, a bottom end 1910, a tuner adapter 1915, and an actuator attachment 1920. Consistent with embodiments of the invention, transition piece 1425 may comprise, for example, a rectangular to round transition piece that may connect a round waveguide (e.g. wave guide 1010) to a rectangular rotating piece (e.g. rotating wave guide 1420). The combination of these two pieces (e.g. rotating wave guide 1420 and transition piece 1425) may allow the rectangular piece (e.g. rotating wave guide 1420) to rotate with respect to the round piece (e.g. wave guide 1010).

Top end 1905 may connect to rotating wave guide 1420 while bottom end 1910 may contact (but may not be attached to) burner probe 1005. A tangential force may be applied to actuator attachment 1920 by an actuator (not shown) to cause transition piece 1425 to rotate circularly. For example, transition piece 1425 may rotate 90 degrees. Because transition piece 1425 may be connected to rotating wave guide 1420, rotating wave guide 1420 may rotate with transition piece 1425. Furthermore, because transition piece 1425 may not be attached to burner probe 1005, burner probe 1005 may not rotate with transition piece 1425. Accordingly, consistent with embodiments of the present invention, while transition piece 1425 rotates, the microwave pattern inside wave guide 1010 (e.g. first wave guide) may be rotated without, for example, moving wave guide 1010. Rotating the wave pattern inside wave guide 1010 may allow heat generated by the microwaves to spread out evenly across burner probe 1005 connected to wave guide 1010. This may allow more energy to be delivered to burner probe 1005 and may limit or eliminate hot spots in burner probe 1005.

Figure 20:
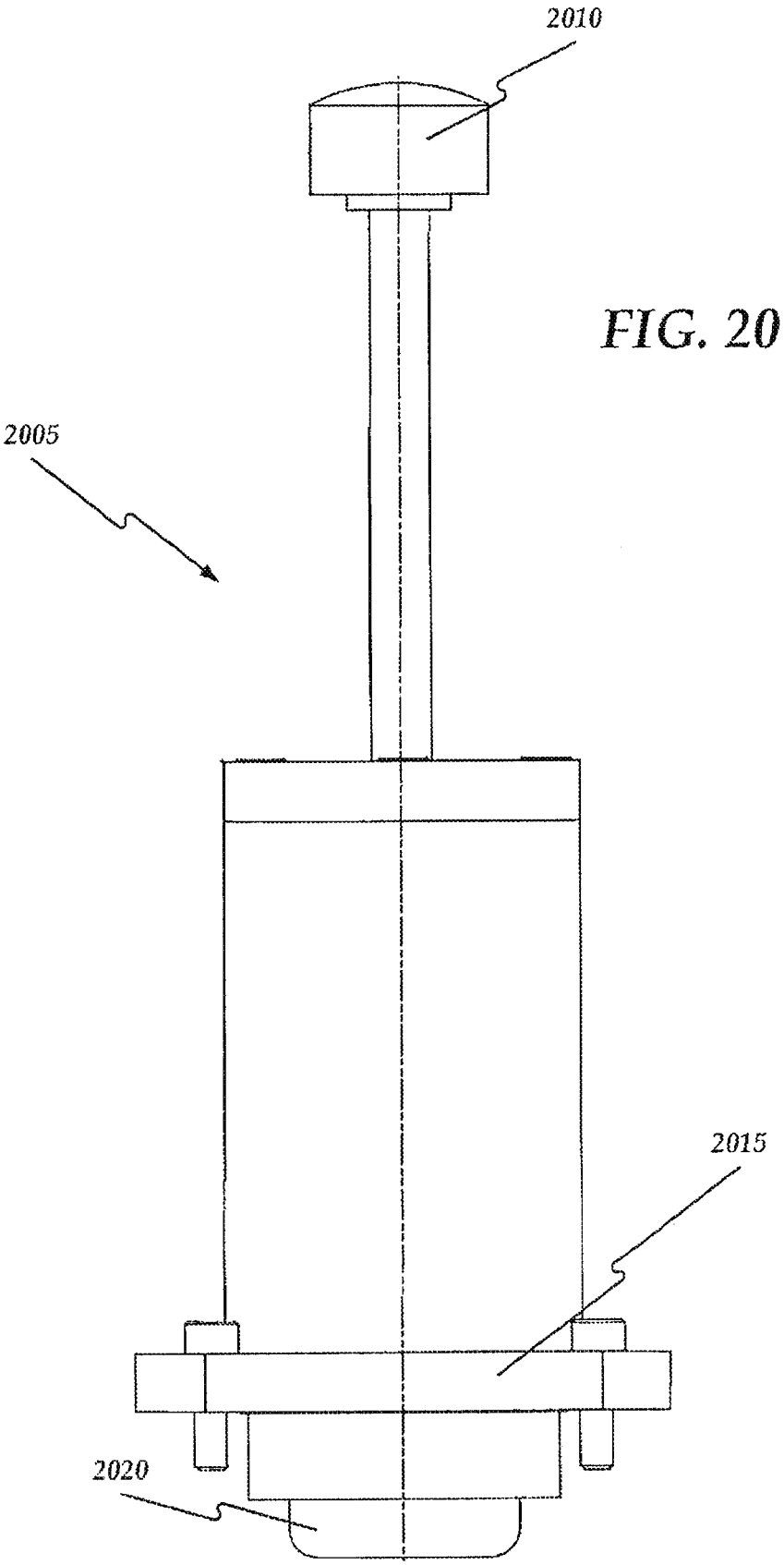
FIG. 20 shows a tuner.

Consistent with embodiments of the invention, at least one tuner may be employed in substance melting system 1405 to cause a minimal amount of microwave energy to be reflected back, for example, into second wave guide 1415 or ultimately back into microwave generator 1410. FIG. 20 shows a tuner 2005. As shown in FIG. 20, tuner 2005 may include a tuner knob 2010, a tuner mounting plate 2015, and a plunger 2020. One or more tuners 2005 may be mounted in substance melting system 1405, for example, on transition piece 1425. Tuner mounting plate 2015 may be attached to tuner adapter 1915. The amount of microwave energy reflected back into microwave generator 1410 may be monitored. Then tuner knob 2010 may be adjusted (e.g. rotated by hand, servo motor, etc.) to minimize or even eliminate the monitored microwave energy that is reflected back into microwave generator 1410. As tuner knob 2010 is adjusted, the extent to which plunger 2020 extends into a cavity inside transition piece 1425 may be correspondingly adjusted. The extent to which plunger 2020 extends into the cavity inside transition piece 1425 may affect the microwave energy that is reflected back into microwave generator 1410.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A system for melting a substance, the system comprising:

at least one burner probe comprising, a first wave guide configured to transmit microwaves; and an absorber configured to, receive the microwaves from the first wave guide, and convert energy from the microwaves into heat;

a second wave guide; and a rotating wave guide positioned between the first wave guide and the second wave guide.

2. The system of claim 1, wherein the first wave guide is round.

3. The system of claim 1, wherein the second wave guide is rectangular.

4. The system of claim 1, wherein the rotating wave guide comprising a plurality of sections configured to rotate about a central axis.

5. The system of claim 4, further comprising a plurality of wear plates respectively between each of the plurality of sections.

6. The system of claim 5, wherein each of the plurality of wear plates is brass.

7. The system of claim 1, wherein at least one connection in the rotating wave guide comprising an electromagnetic interference (EMI) gasket.

8. The system of claim 1, wherein the rotating wave guide comprises a plurality of sections configured to rotate about a central axis, the rotating wave guide configured to rotate approximately 90 degrees.

9. The system of claim 1, wherein the rotating wave guide comprises three sections configured to rotate about a central axis, each one of the three sections configured to rotate approximately 30 degrees.

10. The system of claim 1, further comprising a fixed piece positioned between the rotating wave guide and the first wave guide.

11. The system of claim 1, further comprising a transition piece positioned between the rotating wave guide and the first wave guide.

12. The system of claim 11, wherein the transition piece comprising at least one tuner.

13. The system of claim 12, wherein the at least one tuner is configured to cause a minimal amount of microwave energy to be reflected back into the second wave guide.

14. The system of claim 11, further comprising a fixed piece positioned between the rotating wave guide and the transition piece.

15. The system of claim 1, further comprising a microwave generator.

16. The system of claim 1, further comprising a microwave generator configured to supply microwaves to the second wave guide.

17. The system of claim 1, further comprising a crucible.

18. The system of claim 17, wherein the at least one burner probe extends into the crucible.

19. A system for melting a substance, the system comprising:

a crucible;

at least one burner probe extending into the crucible, the at least one burner probe comprising, a first wave guide configured to transmit microwaves; and an absorber configured to, receive the microwaves from the first wave guide, and convert energy from the microwaves into heat;

a second wave guide; and a rotating wave guide positioned between the first wave guide and the second wave guide, wherein the rotating wave guide comprises a plurality of sections configured to rotate about a central axis.

20. A system for melting a substance, the system comprising:

a crucible;

at least one burner probe extending into the crucible, the at least one burner probe comprising, a first wave guide configured to transmit microwaves; and an absorber configured to, receive the microwaves from the first wave guide, and convert energy from the microwaves into heat;

a second wave guide;

a rotating wave guide positioned between the first wave guide and the second wave guide, wherein the rotating wave guide comprises three sections configured to rotate about a central axis, each one of the three sections configured to rotate approximately 30 degrees;

a microwave generator configured to supply microwaves to the second wave guide; and a transition piece positioned between the rotating wave guide and the first wave guide, wherein the transition piece comprises at least one tuner, wherein the at least one tuner is configured to cause a minimal amount of microwave energy to be reflected back into the microwave generator.

* * * * *